US006778936B2

(12) United States Patent
Johansson

(10) Patent No.: US 6,778,936 B2
(45) Date of Patent: Aug. 17, 2004

(54) CONSISTENCY DETERMINING METHOD AND SYSTEM

(75) Inventor: Ola M. Johansson, Brookfield, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 0 days.

(21) Appl. No.: 09/814,232

(22) Filed: Mar. 20, 2001

(65) Prior Publication Data

US 2003/0004676 A1 Jan. 2, 2003

Related U.S. Application Data

(63) Continuation-in-part of application No. 09/520,915, filed on Mar. 8, 2000, now Pat. No. 6,314,381.

(60) Provisional application No. 60/190,743, filed on Mar. 20, 2000, and provisional application No. 60/196,279, filed on Apr. 9, 2000.

(51) Int. Cl.[7] ..... G06F 19/00; G01N 33/34

(52) U.S. Cl. ..... 702/128; 700/122; 700/127; 700/128; 241/24.19; 241/24.2; 162/23; 162/238

(58) Field of Search ..... 702/128, 130, 702/138, 140, 182; 700/108, 122, 127, 128; 241/24.29, 24.19, 24.2; 162/23, 234, 238; 73/53.03, 53.04

(56) References Cited

U.S. PATENT DOCUMENTS

| | | | |
|---|---|---|---|
| 1,151,131 | A | 8/1915 | Starliper |
| 2,116,584 | A | 5/1938 | Shelby |
| 2,335,358 | A | 11/1943 | Ray |
| 2,353,444 | A | 7/1944 | Conradty et al. |
| 2,843,646 | A | 7/1958 | Conant |
| 3,069,752 | A | 12/1962 | Sherning |

(List continued on next page.)

FOREIGN PATENT DOCUMENTS

| | | |
|---|---|---|
| CA | CN 2183700 | 2/1997 |
| CH | 546 600 | 6/1972 |

(List continued on next page.)

OTHER PUBLICATIONS

W.E. Lunan, K.B. Miles and W.D. May, *The Effect of Differential Pressure on Energy Consumption in Thermo-mechanical Pulping*, Journal of Pulp and Paper Science: vol. 11, No. 5, Sep. 1985, pp. J129–J135.

K.B. Miles and W.D. May, Pulp and Paper Research Institute of Canada, *Predicting the Performance of a Chip Refiner: A Constitutive Approach*, 1991 International Mechanical Pulping Conference, pp. 295–301.

(List continued on next page.)

*Primary Examiner*—Patrick Assouad
(74) *Attorney, Agent, or Firm*—Boyle, Fredrickson, Newholm, Stein & Gratz, S.C.

(57) ABSTRACT

A system (30) and method for determining stock consistency and for using consistency as a process variable to control some aspect of operation of a refiner (32) used to refine stock. The system includes at least one sensor (70 or 180) from which some refiner characteristic is obtained that is used by a processor (38) in determining consistency. The method uses the characteristic, such as temperature or pressure inside the refiner or in a refining zone (304) of the refiner, along with at least one other refiner parameter in determining consistency. A controller (274) uses the consistency determined in controlling some aspect of refiner operation. In one preferred controller, consistency is compared with a consistency setpoint and adjustments are made to try to converge consistency with the setpoint. The controller can be paused to accommodate other changes made to refiner operation and released when steady state refiner operation is achieved.

68 Claims, 25 Drawing Sheets

U.S. PATENT DOCUMENTS

| | | | |
|---|---|---|---|
| 3,091,844 | A | 6/1963 | Laine |
| 3,309,031 | A | 3/1967 | McMahon et al. |
| 3,379,578 | A | 4/1968 | McTaggart et al. |
| 3,466,200 | A | 9/1969 | Mellor et al. |
| 3,539,400 | A | 11/1970 | Pustell |
| 3,553,827 | A | 1/1971 | Baker et al. |
| 3,604,645 | A | 9/1971 | Keyes, IV |
| 3,617,006 | A | 11/1971 | Jones |
| 3,617,717 | A | 11/1971 | Smith |
| 3,650,891 | A | 3/1972 | Dahlin |
| 3,711,687 | A | 1/1973 | Stout et al. |
| 3,847,359 | A | 11/1974 | Holmes et al. |
| 3,867,205 | A | 2/1975 | Schley |
| 3,947,668 | A | 3/1976 | Al-Shaikh et al. |
| 4,023,739 | A | 5/1977 | Lampe et al. |
| 4,060,716 | A | 11/1977 | Pekrul et al. |
| 4,070,761 | A | 1/1978 | Collins |
| 4,071,451 | A | 1/1978 | Wood |
| 4,148,439 | A | 4/1979 | Flodén |
| 4,184,204 | A | 1/1980 | Flohr |
| 4,211,324 | A | 7/1980 | Ohlbach |
| 4,227,927 | A | 10/1980 | Black et al. |
| 4,268,381 | A | 5/1981 | Hooper |
| 4,313,465 | A | 2/1982 | Holzem et al. |
| 4,314,878 | A | 2/1982 | Lee |
| 4,430,221 | A | 2/1984 | Spiewok |
| 4,454,991 | A | 6/1984 | Brenholdt |
| 4,498,137 | A | 2/1985 | Flohr |
| 4,581,300 | A | 4/1986 | Hoppin |
| 4,581,813 | A | 4/1986 | Terhune |
| 4,582,568 | A | 4/1986 | Iyengar |
| 4,587,707 | A | 5/1986 | Nishida et al. |
| 4,614,296 | A | 9/1986 | Lesgourgues |
| 4,626,318 | A | 12/1986 | Prough et al. |
| 4,627,578 | A | 12/1986 | Whyte |
| 4,661,911 | A | 4/1987 | Ellery, Sr. |
| 4,670,215 | A | 6/1987 | Morishita et al. |
| 4,672,529 | A | 6/1987 | Kupersmit |
| 4,673,875 | A | 6/1987 | Kjellzvist et al. |
| 4,688,726 | A | 8/1987 | Brenholdt |
| 4,730,252 | A | 3/1988 | Bradshaw |
| 4,745,254 | A | 5/1988 | Funk |
| 4,820,980 | A | 4/1989 | Dodson-Edgars |
| 4,837,417 | A | 6/1989 | Funk |
| 4,858,103 | A | 8/1989 | Takeuchi et al. |
| 4,878,020 | A | 10/1989 | Kärnä et al. |
| 4,887,208 | A | 12/1989 | Schneider et al. |
| 4,920,488 | A | 4/1990 | Filley |
| 4,943,347 | A | 7/1990 | Floden |
| 4,950,986 | A | 8/1990 | Guerrero |
| 4,972,318 | A | 11/1990 | Brown et al. |
| 4,980,123 | A | 12/1990 | Gedeon et al. |
| 4,994,971 | A | 2/1991 | Poelstra |
| 5,007,985 | A | 4/1991 | Engstrand et al. |
| 5,009,774 | A | 4/1991 | LeBlanc |
| 5,011,065 | A | 4/1991 | Musselmann |
| 5,011,088 | A | 4/1991 | Savonjousi |
| 5,011,090 | A | 4/1991 | Savonjousi |
| 5,016,824 | A | 5/1991 | Pietinen et al. |
| 5,042,726 | A | 8/1991 | Reinhall |
| 5,063,380 | A | 11/1991 | Wakura |
| 5,064,536 | A | 11/1991 | Bratten |
| 5,067,660 | A | 11/1991 | Reinhall |
| 5,071,514 | A | 12/1991 | Francis |
| 5,081,039 | A | 1/1992 | Buttke et al. |
| 5,091,713 | A | 2/1992 | Horne et al. |
| 5,233,542 | A | 8/1993 | Hohner et al. |
| 5,425,508 | A | 6/1995 | Chaney |
| 5,445,328 | A | 8/1995 | Musselman |
| 5,491,340 | A | 2/1996 | Saarinen |
| 5,500,088 | A | 3/1996 | Allison et al. |
| 5,500,735 | A | 3/1996 | Bentley et al. |
| 5,544,819 | A | 8/1996 | Shepherd |
| 5,555,171 | A | 9/1996 | Sonehara et al. |
| 5,581,019 | A | 12/1996 | Minor et al. |
| 5,586,305 | A | 12/1996 | Eidson et al. |
| 5,600,058 | A | 2/1997 | Preikschat et al. |
| 5,601,690 | A | 2/1997 | Gauld et al. |
| 5,638,284 | A | 6/1997 | Helmer et al. |
| 5,666,493 | A | 9/1997 | Wojcik et al. |
| 5,680,320 | A | 10/1997 | Helmer et al. |
| 5,682,473 | A | 10/1997 | Carson et al. |
| 5,684,247 | A | 11/1997 | Preikschat |
| 5,687,098 | A | 11/1997 | Grumstrup et al. |
| 5,691,636 | A | 11/1997 | Allshouse et al. |
| 5,718,389 | A | 2/1998 | Finken et al. |
| 5,745,365 | A | 4/1998 | Parker |
| 5,747,707 | A | 5/1998 | Johansson et al. |
| 5,758,329 | A | 5/1998 | Wojcik et al. |
| 5,823,453 | A | 10/1998 | Garasimowicz |
| 5,825,653 | A | 10/1998 | Huovila et al. |
| 5,966,679 | A | 10/1999 | Snowbarger et al. |
| 5,975,438 | A | 11/1999 | Garasimowicz |
| 5,991,636 | A | 11/1999 | Won et al. |
| 6,024,309 | A | 2/2000 | Karlström |
| 6,092,003 | A | 7/2000 | Hagart-Alexander et al. |
| D431,826 | S | 10/2000 | Karlström |
| 6,157,916 | A | 12/2000 | Hoffman |
| 6,200,421 | B1 | 3/2001 | Meinander |
| 6,206,309 | B1 | 3/2001 | Danielsson et al. |
| 6,290,816 | B1 | 9/2001 | Graf |
| 6,314,381 | B1 | 11/2001 | Johansson |
| 6,317,701 | B1 | 11/2001 | Pyotsia et al. |
| 6,324,490 | B1 | 11/2001 | Johansson et al. |
| 6,502,774 | B1 | 1/2003 | Johansson et al. |
| 6,567,766 | B2 * | 5/2003 | Johansson et al. ..... 702/184 |
| 2001/0032898 | A1 | 10/2001 | Bankes et al. |
| 2001/0044670 | A1 * | 11/2001 | Johansson ..... 700/128 |
| 2002/0013635 | A1 | 1/2002 | Gotou et al. |
| 2003/0065453 | A1 * | 4/2003 | Johansson ..... 702/22 |

FOREIGN PATENT DOCUMENTS

| | | |
|---|---|---|
| DE | 2145096 | 1/1973 |
| EP | 0640395 A1 | 3/1995 |
| FR | 2339703 | 8/1977 |
| GB | 1 468 649 | 12/1975 |
| GB | 28667 | 1/2001 |
| WO | WO 83/01969 | 6/1983 |
| WO | WO 89/00624 | 1/1989 |
| WO | WO 96/14156 | 5/1996 |
| WO | WO 97/23018 | 6/1997 |
| WO | WO 97/24596 | 7/1997 |
| WO | WO 97/38792 | 10/1997 |
| WO | WO 98/48936 | 11/1998 |
| WO | WO 98/58243 | 12/1998 |

OTHER PUBLICATIONS

H.R. Dana, W.D. May, K.B. Miles and B.G. Newman, Pulp and Paper Research Institute of Canada, Pointe Claire, P.Q., *A Study of Steam Flow and Self–Pressurization in Chip Refiners*, Transactions, vol. 1, No. 3, Sep. 1975, pp. 82–88.

K.B. Miles and W.D. May, Pulp and Paper Research Institute of Canada 1989 Annual Meeting, *The Flow of Pulp in Chip Refiners*, pp. A177–A188.

William Herbert and P.G. Marsh, *Mechanics and Fluid Dynamics of a Disk Refiner*, Tappi, vol. 51, No. 5, May 1968, pp. 235–239.

A Master's thesis by Alexander Horch, *Modeling and Control of a Thermo Mechanical Pulp Refiner*, Dec. 7, 1995.

Helmut Becker, Hans Höglund and Göran Tistad, *Frequency and temperature in chip refining*, Paperi ja Puu–Papper och Trä, No. 3, 1977.

D. Atack and M.I. Stationwala, Pulp and Paper Research Institute of Canada, *On the Measurement of Temperature and Pressure in the Refining Zone of an Open Discharge Refiner*, Transactions, vol. 1, No. 3, pp. 71–76, Sep. 1975.

Esko Härkönen, Seppo Ruottu, Ari Ruotu and Ola Johansson, *A Theoretical Model for a TMP–Refiner*, Jun. 9–13, 1997, pp. 95–102, 1997 International Pulping Conference, Stockholm, Sweden.

B.G. Newman, M.I. Stationwala and D. Atack, Pulp and Paper Research Institute of Canada, *Analysis of Steam Flow in Disc Refining*, SPCI International Mechanical Pulping Conference, May 6–10, 1985, pp. 60–67.

Per A Gradin, Ola Johansson, Jan–Erik Berg and Staffan Syström, *Measurement of the Power Distribution in a Single Disc Refiner*, J. Pulp Paper Science 25, No. 11: 384–387 (1999).

M.I. Stationwala, D. Atack, J.R. Wood, D.J. Wild, and A. Karnis, Pulp and Paper Research Institute of Canada, *The Effect of Control Variables on Refining Zone Conditions and Pulp Properties*, Pap. Puu 73, No. 1: 62–69 (Jan. 1991).

Marc. J. Sabourin, Eric Xu, j. Brad Cort, Ivan Boileau and Andrew Waller, *Optimizing Residence Time, Temperature and Speed to Improve TMP Pulp Properties and Reduce Energy*, Pulp Pap. Can. 98, No. 4: 38–45, Apr. 1997.

K.B. Miles, H.R. Dana and W.D. May, *The Flow of Steam in Chip Refiners*, CCPA Conf. Technol. E. Stivale 55–60 (Jun. 2–5, 1982), pp. 30–42.

Ola Johansson, Mark Frith, Bo Falk and Robert Gareau, *Thermopulp®—Recent Process Developments and Experiences*, 84$^{th}$ Annual Meeting of the Technical Section of the CCPA: Papers Presented Jan. 29–30, 1998, pp. 1–11.

OMEGA Thermocouple Calibrator Handbook (1996).

Ali P. Haapanen, Pulp and Paper Technical Association of Canada 86$^{th}$ Annual Meeting Papers (2000), *On–Line Temperature Measurement for Paper Machine Dryers: A New Way to Monitor and Improve Performance* , pp. B81–B84.

83$^{rd}$ Annual Meeting, Technical Section, Canadian Pulp & Paper Association, Papers Presented on Tuesday and Wednesday, Jan. 28–29, 1997, Preprints A, *Electronic Customer Data Management System*, pp. A53–A56.

OMEGADYNE™ Pressure, Force, Load Torque Databook (1996), Chapters B, C, D, E, F, G, H, and J.

Bill Gough, John Kay, and Greg Seebach, Canadian Pulp & Paper Association, Technical Section, 79$^{th}$ Annual Meeting, Preprints A, *Adaptive Control Applications in Pulp and Paper*, pp. A73–A84, Jan. 26–27, 1993.

Luc Charbonneau and Philip Plouffe, Canadian Pulp & Paper Association, Technical Section, 79$^{th}$ Annual Meeting, Preprints A, *Sensodec–10—Condition Monitoring System*, pp. A109–A118, Jan. 26–27, 1993.

M. Spence, K. Danielson, Y. Ying, and M. Rao, Canadian Pulp & Paper Association, Technical Section, 79$^{th}$ Annual Meeting, Preprints A, *On–Line Advisory Expert System Development at Daishowa Peace River–Pulp*, pp. A143–A147, Jan. 26–27, 1993.

Geoff Lawrence, Canadian Pulp & Paper Association, Technical Section, 79$^{th}$ Annual Meeting, Preprints A, *New Measurement and Control System Allows for Simple and Economical DCS Integration*, pp. A179–A183, Jan. 26–27, 1993.

James J. Pinto and Pierre Gingras, Canadian Pulp & Paper Association, Technical Section, 79$^{th}$ Annual Meeting, Preprints A, *"Truly" Distributed Control Systems—Through Intelligent, Networked I/O*, pp. A291–A294, Jan. 26–27, 1993.

John R. Lavigne, Pulp and Paper Industry Division, *An Introduction to Paper Industry Instrumentation, Revised Edition*, 1977, Chapters 1, 2, 4, 5, 6, 7, 8, 10, 11, 12, 15, 16, 17, 18, 19 and 20.

B.C. Strand and Anders Mokvist, 1991 Int'l Mech. Pulping Conf. Proc., Jun. 2–5, *On–Line Control and Optimization of the Refining Process Using a Model Based Control System*, pp. 101–108.

Jan Hill, Kari Saarinen, and Roger Stenros, 1991 Int'l Mech. Pulping Conf. Proc., Jun. 2–5, *On the control of chip refining systems*, pp. 235–241.

Kenneth W. Britt, Ed., *Handbook of Pulp and Paper Technology*, 2$^{nd}$ Ed. (1970), Chapter 5.

M. Fournier, H. Ma, P.M. Shallhorn, and A.A. Roche, *Control of Chip Refiner Operation*, 1991 Int'l Mech. Pulping Conf. Proc., pp. 91–100.

Daniel Jutras, Steve A. Rowland, Luis Cortez, and Nelson LaFleur, *The Hymac HXD–64: A New Concept in Refiner Design*, 1991 Int'l Mech. Pulping Conf. Proc., pp. 285–294.

M.I. Stationwala, K.B. Miles, and A. Karnis, *The Effect of First Stage Refining Conditions on Pulp Properties and Energy Consumption*, 1991 Int'l Mech. Pulping Conf. Proc., pp. 321–327.

Art. Jepson, New Wave Screen Baskets Upgrade Existing Systems, 1984 Pulping Conf. TAPPI Proc., pp. 515–520.

OMEGA C01, C02, C03 *"Cement–On" Thermocouples User's Guide* (1996).

Lars Johansson, *Effects of Temperature and Sulfonation on Deformation of Spruce Wood*, Thesis for Dept. of Forest Prods. and Chem. Eng'g, Chalmers University of Technology, Göteborg, Sweden (1997).

OMEGA *Transactions in Measurement and Control*, vol. 3: Force–Related Measurements (1998).

Karin Eriksson, Performance Analysis in TMP Refining, Thesis for Dept. of Signals and Systems, Chalmers University of Technology, Göteborg, Sweden (2001).

BeInZero AB Refiner Control System documentation, "Get to Know Your Refiners", pp. 1–19 and appendices 1 and 2 (2000).

Jan Sundholm, *Papermaking Science and Technology, Book 5: Mechanical Pulping* (1999), chapters 1–4 and 7–10.

Lydia Bley and Roland Berger, *Recent Advances in On–Line Charge Measurements*, 2001 Int'l Mech. Pulping Conf. Proc, pp. 63–72.

François Julien Saint Amand and Bernard Perrin, *Fundamental Aspects of Mechanical Pulp Screening*, 2001 Int'l Mech. Pulping Conf. Proc, pp. 387–406.

B.C. Strand, View on Control Development, 2001 Int'l Mech. Pulping Conf. Proc, pp. 477–480.

Karl Mosbye, Kjell–Arve Kure, Guri Fuglem, Ola Johansson, *Use of Refining Zone Temperature Measurements for Refiner Control*, 2001 Int'l Mech. Pulping Conf. Proc., pp. 481–488.

Olof Ferritsius and Rita Ferritsius, *Experiences from Stora Enso Mills of Using Factor Analysis for Control of Pulp and Paper Quality*, 2001 Int'l Mech. Pulping Conf. Proc., pp. 495–503.

Juha Kortelainen, Anitti Salopuro, Jouko Halttunen, *Prediction of TMP Quality Properties with On–Line Measurements*, 2000 Int'l Mech. Pulping Conf. Proc., pp. 505–512.

Ismo Joensuu, Lennart Karlsson, Jaakko Myllyneva, *Fuzzy Quality Control of a TMP Plant*, 2001 Int'l Mech. Pulping Conf. Proc., pp. 513–521.

Lars Sundström, Roy Tönnesen, and Lennart Nilsson, *Multivariate Monitoring of a Chip Feeding Process*, 2001 Int'l Mech. Pulping Conf. Proc., pp. 523–529.

Petteri Vuorio and Peter Bergquist, *New Refiner Segments Technology to Optimize Fiber Quality and Energy Consumption of Refiner Mechanical Pulp*, 2001 Int'l Mech. Pulping Conf. Proc., pp. 565–577.

Ola Johansson, Dan Hogan, Dale Blankenship, Eddie Snow, Wyllys More, Ronnie Qualls, Keith Pugh, and Mike Wanderer, *Improved Process Optimization Through Adjustable Refiner Plates*, 2001 Int'l Mech. Pulping Conf. Proc., pp. 579–589.

Fredrik Rosenqvist, Karin Eriksson, and Anders Karlström, *Time–Variant Modelling of TMP Refining* (undated).

Fredrik Rosenqvist, Karin Eriksson, and Anders Karlström, *Modelling a Thermomechanical Wood–Chip Refiner* (undated).

Plant Information (PI™) System brochure, OSI Software Inc. (undated).

* cited by examiner

CONSISTENCY DETERMINING METHOD AND SYSTEM

CROSS-REFERENCE TO RELATED APPLICATIONS

This application is a continuation-in-part of presently copending U.S. patent application Ser. No. 09/520,915 that was filed in the U.S. Patent Office on Mar. 8, 2000 now U.S. Pat. No. 6,314,381. This application also claims priority under 35 U.S.C. §119(e) to U.S. Provisional Patent Application No. 60/190,743, filed Mar. 20, 2000, and U.S. Provisional Patent Application No. 60/196,279, filed Apr. 9, 2000, the entirety of both which are incorporated by reference herein.

FIELD OF THE INVENTION

The present invention relates to a method and system for determining consistency of stock being refined by a disk refiner as well as a method and system for controlling refiner operation based on consistency.

BACKGROUND OF THE INVENTION

Many products we use every day are made from fibers. Examples of just a few of these products include paper, personal hygiene products, diapers, plates, containers, and packaging. Making products from wood fibers, cloth fibers and the like, involves breaking solid matter into fibrous matter. This also involves processing the fibrous matter into individual fibers that become fibrillated or frayed so they more tightly mesh with each other to form a finished fiber product that is desirably strong, tough, and resilient.

In fiber product manufacturing, refiners are devices used to process the fibrous matter, such as wood chips, pulp, fabric, and the like, into fibers and to further fibrillate existing fibers. The fibrous matter is transported in a liquid stock slurry to each refiner using a feed screw driven by a motor. Each refiner has at least one pair of circular ridged refiner discs that face each other. During refining, fibrous matter in the stock to be refined is introduced into a gap between the discs that usually is quite small. Relative rotation between the discs during operation causes the fibrous matter to be fibrillated as the stock passes radially outwardly between the discs.

One example of a refiner that is a disc refiner is shown and disclosed in U.S. Pat. No. 5,425,508. However, many different kinds of refiners are in use today. For example, there are counterrotating refiners, double disc or twin refiners, and conical disc refiners. Conical disc refiners are often referred to in the industry as CD refiners.

Each refiner has at least one motor coupled to a rotor carrying at least one of the refiner discs. During operation, the load on this motor can vary greatly over time depending on many parameters. For example, as the mass flow rate of the stock slurry being introduced into a refiner increases, the load on the motor increases. It is also known that the load on the motor will decrease as the flow rate of dilution water is increased.

During refiner operation, a great deal of heat is produced in the refining zone between each pair of opposed refiner discs. The refining zone typically gets so hot that steam is produced, which significantly reduces the amount of liquid in the refining zone. This reduction of liquid in the refining zone leads to increased friction between opposed refiner discs, which increases the load on the motor of the refiner. When it becomes necessary to decrease this friction, water is added to the refiner. The water that is added is typically referred to as dilution water.

One problem that has yet to be adequately solved is how to control refiner operation so that the finished fiber product has certain desired characteristics that do not vary greatly over time. For example, paper producers have found it very difficult to consistently control refiner operation from one hour to the next so that a batch of paper produced has consistent quality. As a result, it is not unusual for some paper produced to be scrapped and reprocessed or sold cheaply as job lot. Either way, these variations in quality are undesirable and costly.

Another related problem is how to control refiner operation to repeatedly obtain certain desired finished fiber product characteristics in different batches run at different times, such as different batches run on different days. This problem is not trivial as it is very desirable for paper producers be able to produce different batches of paper having nearly the same characteristics, such as tear strength, tensile strength, brightness, opacity and the like.

In the past, control systems and methods have been employed that attempt to automatically control refiner operation to solve at least some of these problems. One common control system used in paper mills and fiber processing plants throughout the world is a Distributed Control System (DCS). A DCS communicates with each refiner in the mill or fiber processing plant and often communicates with other fiber product processing equipment. A DCS monitors operation of each refiner in a particular fiber product processing plant by monitoring refiner parameters that typically include the main motor power, the dilution water flow rate, the hydraulic load, the feed screw speed, the refiner case pressure, the inlet pressure, and the refiner gap. In addition to monitoring refiner operation, the DCS also automatically controls refiner operation by attempting to hold the load of the motor of each refiner at a particular setpoint. In fact, many refiners have their own motor load setpoint. When the motor load of a particular refiner rises above its setpoint, the DCS adds more dilution water to the refiner to decrease friction. When the motor load decreases below the setpoint, dilution water is reduced or stopped.

During refiner operation, pulp quality and the load on the refiner motor vary, sometimes quite dramatically, over time. Although the aforementioned DCS control method attempts to account for these variations and prevent the aforementioned problems from occurring, its control method assumes that the mass flow of fibrous matter in the stock entering the refiner is constant because the speed of the feed screw supplying the stock is constant. Unfortunately, as a result, there are times when controlling the dilution water flow rate does not decrease or increase motor load in the desired manner. This disparity leads to changes in refining intensity and pulp quality because the specific energy inputted into refining the fibrous matter is not constant. These changes are undesirable because they ultimately lead to the aforementioned problems, as well as other problems.

In the past, consistency has been measured externally of a refiner in an effort to determine how well the refiner is operating. After evaluating the consistency measurement, there are times where an operator will manually make an adjustment to the refiner in an effort to try to get the consistency closer to a desired value or range. Unfortunately, it takes a long time, often several hours or longer, before the operator will know whether his or her adjustment had the desired impact on consistency. This hit and miss approach is inexact and inefficient.

This delay is believed to be caused by at least two problems, if not more. First, it takes a long time, often several hours or possibly even days, for the refiner to reach steady state operation before an operator will know what kind of effect that the change had. Second, consistency measurements are taken outside the refiner using equipment and methods that are slow, which also delays how fast an operator can obtain feedback. In any event, because the present methods and devices for measuring consistency are slow and there is a corresponding delay in recognizing that the refiner is operating in a steady state condition, the operator is forced to wait a long time until they know with some certainty what kind of effect their change had. This means, that the refiner can operate inefficiently for hours, if not days, before the operator, using this trial and error method, finally settles on a combination of operating settings that are more to his or her liking.

Hence, while some refiner process control methods have proven beneficial in the past, they in no way have resulted in the type of control over finished fiber product parameters and the repeatability of these parameters that is desired. Thus, additional improvements in refiner process control and consistency measurement are needed.

SUMMARY OF THE INVENTION

A system for and method of determining stock consistency. The invention includes one or more sensors that sense temperature and/or pressure of stock adjacent or in the refining zone during refiner operation. In one preferred embodiment, one or more sensors in the refining zone provide real time temperature and/or pressure data from which a consistency is determined. A plurality of sensors can be used. Sensors can be distributed radially along the refining zone to provide a distribution of temperature and/or pressure data from which a consistency is determined. Using the system and method of the invention, consistency can be quickly measured in no more than five minutes and preferably is measured in real time. In one preferred embodiment and method, consistency is measured a plurality of times a second and preferably at a rate of about twenty times a second.

The consistency can then be used to control or help control refiner operation. For example, in one preferred embodiment, the dilution water to the refiner is regulated based on stock consistency. In another preferred method, the volumetric flow rate of the stock is regulated based on stock consistency. If desired, regulation of volumetric flow rate and dilution water can both be based on stock consistency. If desired, another parameter, such as refiner gap, can be regulated based on consistency.

Where refiner temperature is used in determining consistency, the refiner temperature is a temperature of stock inside the refiner or adjacent its inlet or outlet. In one preferred implementation, the refiner temperature is a temperature of stock in the refining zone. Where there is more than one sensor in the refining zone, the temperature can be provided by a particular selected sensor or calculated based on the sensor data from more than one sensor. In one preferred embodiment, temperature measurements from multiple sensors are averaged. In another embodiment, a temperature profile using data from each sensor is used.

Where refiner pressure is used in determining consistency, the pressure preferably is a pressure inside the refiner, such as a pressure in the refining zone, or a pressure inside the refiner adjacent an inlet or outlet. Where there is more than one sensor in the refining zone, the pressure can be provided by a particular selected sensor or calculated based on the sensor data from more than one sensor. In one preferred embodiment, pressure measurements from multiple sensors are averaged. In another embodiment, a pressure profile using data from each sensor is used.

In one preferred implementation of the method of determining consistency, the method uses temperature or pressure measured inside the refining zone along with other refiner parameters in determining the consistency of stock in the refining zone as a function of time and location in the refining zone. This method advantageously permits consistency of stock to be determined in real time in the refining zone.

Where volumetric stock flow or mass flow is regulated, it preferably is regulated by controlling the speed of a feed screw that provides the refiner with stock or fiber for stock. Where dilution water flow is regulated, it preferably is regulated by controlling operation of the dilution pump. Other refiner parameters can be controlling using the method of this invention.

So that the process can be controlled despite changes in refiner operation not due to regulation using the method, one preferred implementation pauses to permit refiner operation to stabilize before resuming regulation of refiner operation. For example, where an operator manually changes refiner operation, regulation is paused preferably until refiner operation stabilizes. The same is true where a refiner is also subject to control of a processing device, such as a Distributed Control System (DCS).

In one preferred embodiment, the method is implemented in the form of a controller that preferably is a PI or a PID controller. If desired, a proportional controller can be used. The controller can be a digital or analog controller and can be configured to operate with a processor such as the digital processor of a personal computer, a DCS, a programmable controller or the like.

The system includes a processor that receives data related to refiner operation. Suitable data includes data related to the process variable or variables used in regulating refiner operation. In one preferred embodiment, the processor receives data related to one or more of the following parameters: the power inputted into the refiner, the feed screw speed (or volumetric stock flow or feed rate), the temperature of the stock before it enters the refiner, the temperature of stock after it leaves the refiner, a refiner temperature, a refiner pressure, the force exerted on the refiner disks urging them together, the dilution motor power of the dilution pump, the chip washing water temperature, the dilution water temperature, the gap between the refiner disks, as well as other parameters. At least three of these parameters are used in determining consistency.

In carrying out a method of refiner control using consistency, the processor outputs at least one control signal. Each control signal can be directly provided to the refiner or a component related to the refiner, such as the feed screw or dilution water pump. If desired, each control signal can be provided to another processor, such as a DCS, that causes the DCS to regulate the desired parameter. For example, a control signal can be provided to the DCS that causes the DCS to change feed screw speed. Another control signal can be provided to the DCS that causes the dilution water flow rate to change. Another control signal can be provided to the DCS that causes the refiner gap to change.

Using a method and system of this invention, control changes can be made to the refiner at a rate of at least one every five minutes and preferably faster. For example, in one preferred embodiment, real time control of the refiner is achieved. Preferably, the system and method enables a plurality of the aforementioned setting changes to be made per second and as fast as at a rate of about twenty hertz.

In one preferred embodiment, each sensor is carried by a refiner disk or segment of the disk. In one preferred sensor disk or sensor disk segment, each sensor is imbedded in the refining surface of the disk or segment.

In a preferred sensor embodiment, the sensor has a sensing element carried by a spacer that spaces the sensing element from the material of the disk or segment in which it is imbedded. This prevents the sensor from detecting the temperature of the disc or disc segment, and, instead, when insulated, the sensor detects the temperature of the stock. One preferred spacer is made from an insulating material that preferably thermally insulates the sensing element from the thermal mass of the refiner disk material.

Other objects, features, and advantages of the present invention include one or more of the following: a method and system for determining consistency at or close to the refining zone; a method and system for determining consistency in real time in the refining zone; a method and system for determining consistency in the refining zone as a function of position in the refining zone; a method and system for using determined consistency in controlling some aspect of refiner operation; a method and system that controls refiner operation in real time based on consistency measured in real time; and a method and system for controlling refiner operation based on consistency that accommodates changes to other refiner settings; is a method and system for measuring consistency that is reliable, economical, easy to manufacture and install, repeatable, fast, rugged, and efficient; and is a method and system for controlling refiner operation based on consistency that is also reliable, economical, fast, rugged, and efficient.

Other objects, features, and advantages of the present invention will become apparent to those skilled in the art from the detailed description and the accompanying drawings. It should be understood, however, that the detailed description and accompanying drawings, while indicating at least one preferred embodiment of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which.

DETAILED DESCRIPTION OF PREFERRED EMBODIMENTS

Figure 1:
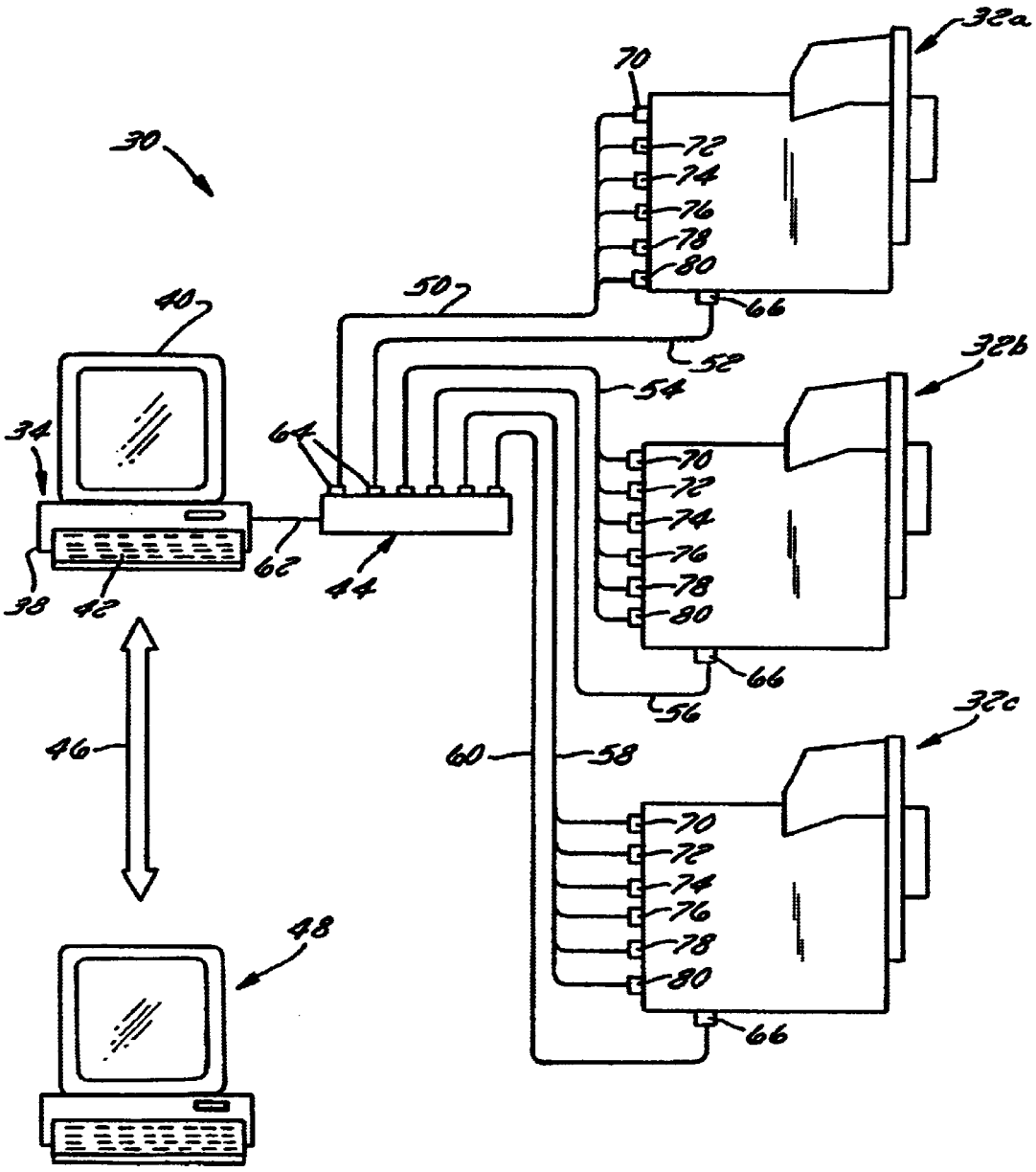
FIG. 1 is a schematic view of a first embodiment of a refiner monitoring and control system.
Figure 5:
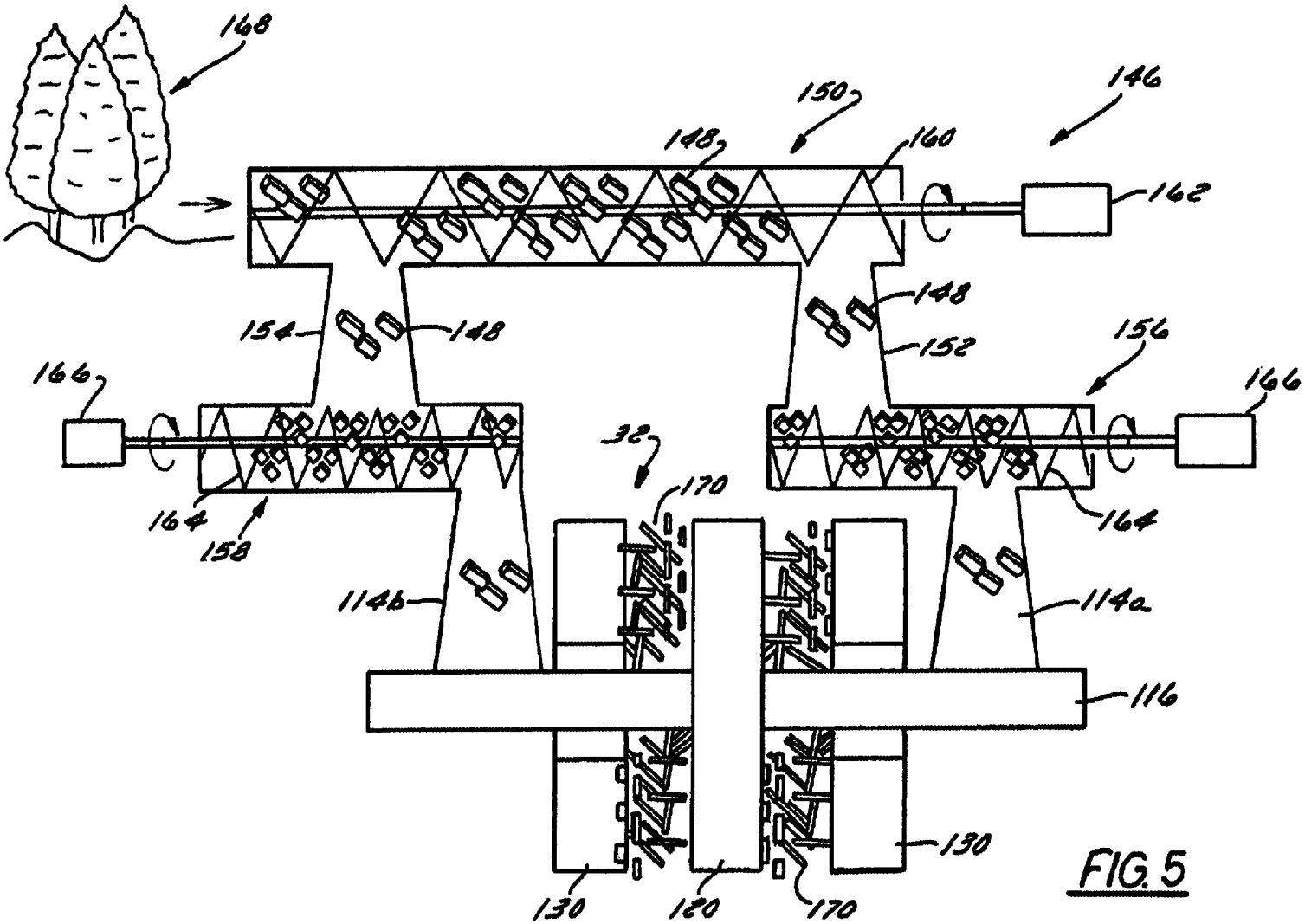
FIG. 5 is a schematic of a system for supplying the refiner with stock.

FIG. 1 schematically illustrates a system 30 for determining consistency of stock being refined and can be used to determine consistency in one or more disc refiners 32*a*, 32*b*, or 32*c*. The system includes a processor 34 that accepts data from sensors from which consistency is determined and performs calculations to determine consistency. In one preferred embodiment, the processor 34 can also control some aspect of operation of a refiner. For example, the processor 34 can also control operation of a feed screw 66, which is shown in FIG. 5, and which is discussed below, that supplies the refiner with stock. The feed screw 66 is not part of the refiner itself and, instead, is a separate part that feeds stock to the refiner. In another preferred embodiment, the processor 34 can also control the flow rate of dilution water to the refiner. The mass flow can be regulated to help keep a process variable at or desirably close to a consistency setpoint that can change during operation. When some aspect of refiner operation is changed, the control processor 34 stops regulation for a period of time to allow the change to take effect and cause a new setpoint to be reached. The control processor 34 then resumes regulating mass flow using the new setpoint.

In a preferred embodiment of the system 30, the processor 34 comprises a computer 38 that can include a display 40, and one or more input/output devices 42, such as a keyboard and/or a mouse. Such a computer 38 can be a personal computer, a mainframe computer, a programmable controller, or another type of processing device. If desired, the computer 38 can have on-board memory and can have an on-board storage device.

In the preferred embodiment shown in FIG. 1, the processor 34 preferably also has or includes an input/output device 44 that comprises at least one data acquisition device or a data acquisition system capable of receiving data from one or more of the refiners 32*a*, 32*b*, and 32*c*. For example, in the embodiment of FIG. 1, at least three refiners 32*a*, 32*b*, and 32*c* are linked to the processor 34. This device 44 can be a separate component linking the processor 34 and the refiners 32*a*, 32*b*, and 32*c* in the manner depicted in FIG. 1, or can be an integral part of the processor 34.

The processor 34 and input/output device 44 can be housed in a cabinet 82 (FIG. 3) that can be located in a fiber processing plant, such as a paper mill or the like. The display 40 can be remotely located, such as in a control room of the fiber processing plant. If desired, the processor 34 can be a Distributed Control System (DCS) at the fiber processing plant or can be a component of the DCS.

The processor 34 can communicate via a link 46 with an off-site computer 48 that is used for troubleshooting and downloading updates or changes to the method of refiner control carried out by the processor 34. Such a link 46 can be a wireless link or a wire link between computers 38 and 48. Examples of suitable links 46 include a link via the Internet, such as an FTP or TCP/IP link, or a direct telephone link.

The processor 34 is directly or indirectly connected by links, indicated by reference numerals 50–60 in FIG. 1, to each one of the refiners 32*a*, 32*b* and 32*c*. For example, one or more of the links 50–60 can comprise a cable or a wireless communication link or the like.

The processor 34 is shown in FIG. 1 as being connected by a link 62 to the input/output device 44. In one preferred embodiment, the device 44 is a data acquisition and control system that includes ports or modules 64. Where data acquisition is needed, each port or module can comprise a data acquisition card. If desired, the device 44 can be comprised of one or more data acquisition cards installed in slots inside computer 38. While FIG. 1 depicts a link from each one of the refiners 32*a*, 32*b*, and 32*c* running to a single card or module, a dedicated card or module can accept two or more such links.

Each refiner 32*a*, 32*b*, and 32*c* has a plurality of sensors that provide data to the processor 34. For example, data from at least one sensor 70 relating to temperature, pressure or a combination of temperature and pressure are communicated via link 50 to processor 34. Data from other sensors 72–80 are also directly or indirectly utilized in determining consistency. For example, sensors 72–80 provide data relating to one or more of the following parameters: refiner main motor power, refiner plate force, the refiner gap, the rate of flow of dilution water added during refining, conveyor screw rotation, the flow rate of fibrous matter being introduced into the refiner, such as fiber mass flow rate and stock flow rate, and/or rotational speed, as well as consistency. Where the processor 34 is a DCS, all of this sensor data is obtained during refiner operation by the DCS.

Where refiner main motor power is monitored, an example of a suitable sensor is one that senses the voltage or current from a current transformer coupled to the refiner motor. Where refiner plate force is monitored, examples of suitable sensors include one or more of the following: an accelerometer, a strain gauge, or a pressure sensor that senses the pressure or force urging the refiner plates toward each other. Where refiner gap is monitored, examples of sensors include one or more of the following: an inductive sensor carried by at least one of the refiner plates or a Hall effect sensor. Where conveyor screw rotation is monitored, a sensor on the conveyor screw motor can be used to provide, for example, the rate of screw rotation. Where rate of flow of dilution water is monitored, a flowmeter can be used. A flowmeter is an example of a sensor that can be used to provide data from which a flow rate of fibrous matter into the refiner can be obtained. Where a flow meter is used, examples of suitable flow meters that can be used include paddle-wheel type sensors, optical sensors, viscosity meters, or other types of flow meters. Sensor data from one or more sensors, including the aforementioned sensors, can be used in making a consistency measurement that can be used as a setpoint by the processor 34.

A number of these refiner-related sensors and other sensors that can be monitored by the system 30 of this invention are disclosed in more detail in one or more of U.S. Pat. Nos. 4,148,439; 4,184,204; 4,626,318; 4,661,911; 4,820,980; 5,011,090; 5,016,824; 5,491,340; and 5,605,290, the disclosures of each of which are expressly incorporated herein by reference.

Figure 2:
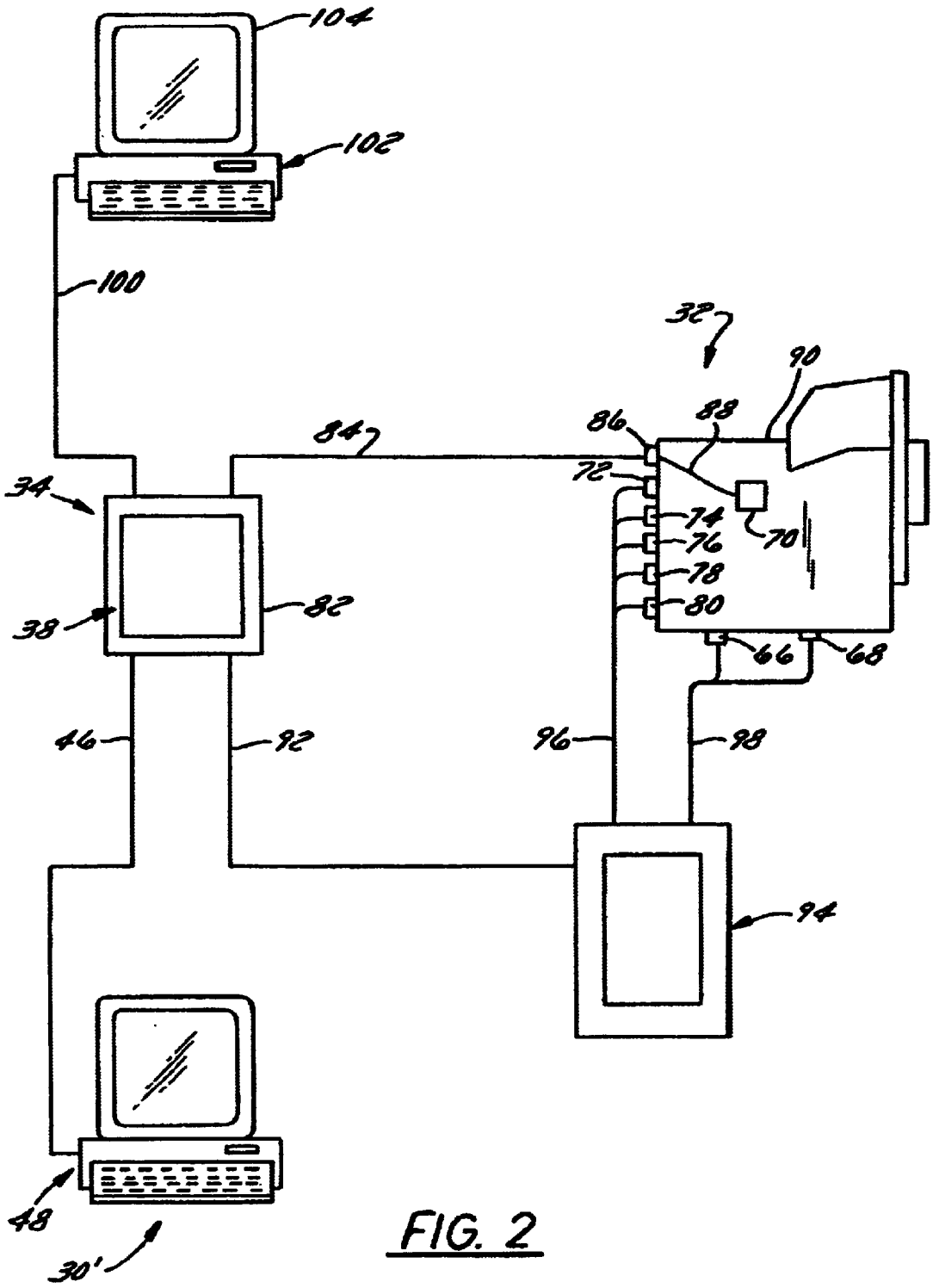
FIG. 2 is a schematic view of a second embodiment of a refiner monitoring and control system.

FIG. 2 schematically illustrates another preferred embodiment of system 30'. The processor 34 is a computer 38 that is located in a cabinet 82 that is located on site. There is a link 84 from the processor 34 to a signal conditioner 86 carried by the refiner 32. The signal conditioner 86 is attached by another link 88 to each sensor 70.

The signal conditioner 86 connects with each sensor 70 and converts the sensor output to an electrical signal that is transmitted to the processor 34. For example, one preferred signal conditioner 86 typically outputs a current (for each sensor) in the range of between four and twenty milliamperes. The magnitude of the signal depends upon the input to the sensor (and other factors including the type of sensor or sensors) and provides the processor the information from which it can determine a sensor measurement. If desired, more than one signal conditioner can be mounted to the casing or housing of the refiner 32. As is depicted in FIG. 2, the signal from each sensor 70 can first be communicated by a link 84 to a DCS 94 before being communicated to processor 34. In some instances, a signal conditioner 86 may not be needed.

For sending information, the processor 34 is connected by a communications link 100, such as a phone line, to a device 102 located in a control room that preferably is located in the fiber processing plant. The device 102 can be a computer that includes a display 104 upon which graphical information is shown that relates to refiner operation and can relate to control.

The processor 34 is depicted in FIG. 2 as being connected by another communications link 92 to a DCS 94 that preferably is located on site. The DCS 94 is connected by a second link 96 to one or more of refiner sensors 72, 74, 76, 78 and 80 that provide the DCS with information about a number of parameters that relate to refiner operation. A third link 98 connects the DCS to each feed screw motor (or feed screw motor controller) 66 and each dilution water motor (or feed screw motor controller) 68, only one of which is schematically depicted in FIG. 2. The link 98 can include a separate link to each feed screw motor (or motor controller) 66 and each dilution water motor (or motor controller) 68 for that particular refiner 32. At least one of the purposes of link 98 is to convey control signals from the DCS to each feed screw motor (or motor controller) 66 and each dilution water motor (or motor controller) 68 to control their operation. Another purpose of link 98 can be to provide feedback about motor speed so that the mass flow rate of the feed screw and flow rate of dilution water can be determined.

The link 92 provides the processor 34 with information from the DCS 94 that preferably includes the main motor power of the refiner 32, the force exerted on the refiner disks urging them together (or hydraulic pressure or force), the dilution motor power of the refiner for each dilution pump, DCS ready status, several other DCS signals, the refiner case pressure, the refiner inlet pressure, the chip washing water temperature, the dilution water temperature, as well as the gap between refiner disks. The link 92 also enables the processor 34 to communicate with the DCS 94 to cause the DCS 94 to change the mass flow rate of stock entering the refiner 32. The link 92 can also be used by the processor 34 to communicate with the DCS 94 to change the rate of flow of dilution water entering the refiner 32. The link 92 preferably comprises a bidirectional communications link. Communication preferably is in the form of a digital or analog control signal sent by the processor 34 to the DCS 94.

Figure 3:
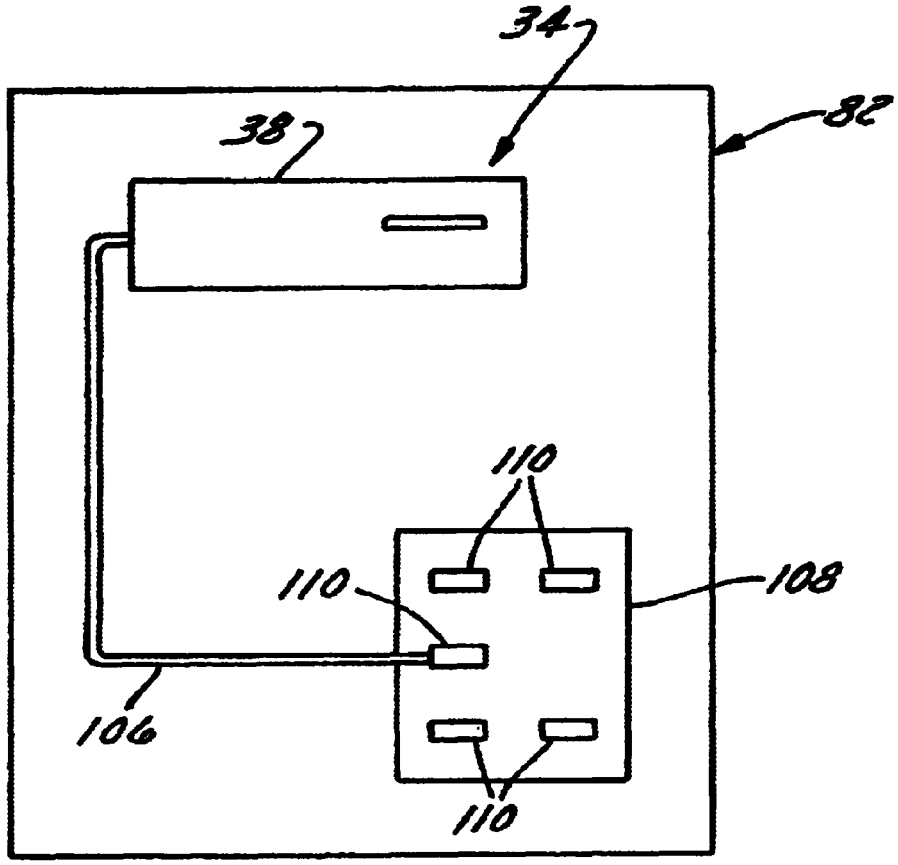
FIG. 3 is front plan view of a cabinet housing a control computer of the refiner monitoring and control system.

FIG. 3 depicts the contents of a cabinet 82 that houses the processor 34. In addition to any needed data acquisition modules or system (not shown in FIG. 3), the processor 34 can communicate via a link 106 with a connector box 108 that includes a plurality of calibration modules 110. Each calibration module 110 holds calibration data for a particular sensor or a particular set of sensors 70. Each calibration module 110 has on board storage or memory, such as an EPROM, EEPROM, or the like, that holds sensor calibration data. When data is read from a particular sensor or a particular set of sensors 70, the calibration data that relates to that particular sensor or that particular group of sensors 70 is applied to make the resultant sensor measurement more accurate.

The refiner 32 can be a refiner of the type used in thermomechanical pulping, refiner-mechanical pulping, chemithermomechanical pulping, or another type of pulping or fiber processing application where a rotary disk refiner is used. The refiner 32 can be a counterrotating refiner, a double disc or twin refiner, or a conical disc refiner known in the industry as a CD refiner.

Figure 4:
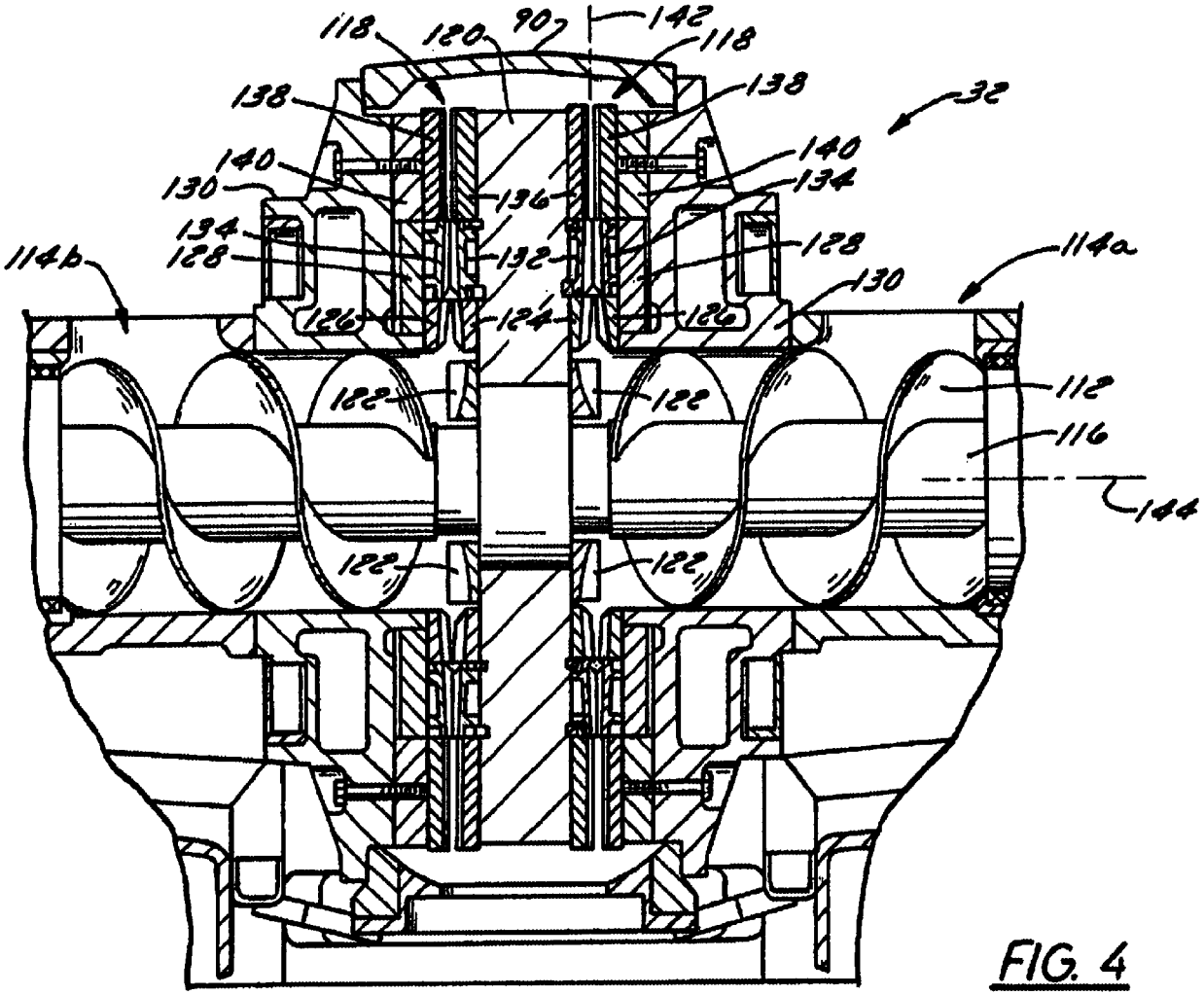
FIG. 4 is a fragmentary cross sectional view of an exemplary twin refiner.

An example of a refiner 32 that is a double disc or twin refiner is shown in FIG. 4. The refiner 32 has a housing or casing 90 and an auger 112 mounted therein which urges a stock slurry of liquid and fiber introduced through a stock inlet 114 into the refiner 32. The auger 112 is carried by a shaft 116 that rotates during refiner operation to help supply stock to an arrangement of treating structure 118 within the housing 90. An annular flinger nut 122 is generally in line with the auger 112 and directs the stock radially outwardly to a plurality of opposed sets of breaker bar segments 124 and 126.

Each set of breaker bar segments 124 and 126 preferably is in the form of sectors of an annulus, which together form an encircling section of breaker bars. One set of breaker bar segments 124 is carried by a rotor 120. The other set of breaker bar segments 126 is carried by another portion of the refiner 32, such as a stationary mounting surface 128, e.g., a stator, of the refiner or another rotor (not shown). The stationary mounting surface 128 can comprise a stationary part 130 of the refiner frame, such as the plate shown in FIG. 4.

Stock flows radially outwardly from the breaker bar segments 124 and 126 to a radially outwardly positioned set of opposed refiner discs 132 and 134. This set of refiner discs 132 and 134 preferably is removably mounted to a mounting surface. For example, disc 132 is mounted to the rotor 120 and discs 134 are mounted to mounting surface 128.

The refiner 32 preferably includes a second set of refiner discs 136 and 138 positioned radially outwardly of the first set of discs 132 and 134. The refiner discs 136 and 138 preferably are also removably mounted. For example, disc 136 is mounted to the rotor 120, and disc 138 is mounted to a mounting surface 140. Each pair of discs of each set are spaced apart so as to define a small gap between them that typically is between about 0.005 inches (0.127 mm) and about 0.125 inches (3.175 mm). Each disc can be of unitary construction or can be comprised of a plurality of segments.

The first set of refiner discs 132 and 134 is disposed generally parallel to a radially extending plane 142 that typically is generally perpendicular to an axis 144 of rotation of the auger 112. The second set of refiner discs 136 and 138 can also be disposed generally parallel to this same plane 142. This plane 142 passes through the refiner gap and refining zone between each pair of opposed refiner disks. Depending on the configuration and type of refiner, different sets of refiner discs can be disposed in different planes.

During operation, the rotor 120 and refiner discs 132 and 136 rotate about axis 144 causing relative rotation between refiner discs 132 and 136 and refiner discs 134 and 138. Typically, each rotor 120 is rotated at a speed of between about 400 and about 3,000 revolutions per minute. During operation, fiber in the stock slurry is refined as it passes between the discs 132, 134, 136, and 138.

FIG. 5 schematically depicts the refiner 32 and includes a fiber delivery system 146 for delivering fibrous matter or fiber to be refined 150 to each inlet 114*a* and 114*b* of the refiner 32. The fibrous matter or fiber 148 can be in the form of wood chips, pulp, fabric, or another fiber used in the manufacturing of products made from, at least in part, fiber. The fiber 148 preferably is carried by or entrained in a liquid to form a stock slurry.

In the exemplary preferred embodiment shown in FIG. 3, the fiber 148 is transported along a fiber transport conveyor 150 that urges fiber (preferably in a stock slurry) along its length until it reaches an outlet that can be connected directly or indirectly to a refiner. In the embodiment shown in FIG. 3, the fiber transport conveyor 150 has outlets 152 and 154 that are each connected to a metering conveyor 156 and 158. Each metering conveyor, in turn, is connected to one of the refiner inlets 114*a* and 114*b*. This arrangement advantageously enables mass flow to be separately and more precisely metered to each refiner inlet 114*a* and 114*b* of a double disc refiner or the like. This arrangement can also be used to distribute and meter fiber 148 to two, three, four, or more refiners using a common conveyor 150 and a separate metering conveyor for each refiner.

In one preferred embodiment, the fiber transport conveyor 150 includes an auger or screw 160 driven by a motor 162 that can be, for example, an electric motor or a hydraulic motor. The motor 162 can be controlled by the DCS 94 or directly controlled by control processor 34, if desired, in regulating mass flow. Where a metering conveyor is used, each metering conveyor 156 and 158 preferably includes an auger or screw 164 driven by a motor 166. Each motor 166 of each metering conveyor 156 and 158 is controlled by the DCS 94 or by processor 34.

As is shown in FIG. 3, trees 168 typically are processed into chips 148 that are transported by conveyor 150 to an outlet 152 or 154. Chips 148 pass from one of the outlets to one of the metering conveyors 156 or 158. The metering rate of each metering conveyor 156 and 158 is controlled by processor 34 to regulate the mass flow rate of stock entering each refiner inlet 114*a* and 114*b*. After being refined by the refiner 32, the refined fiber 170 can be transported to another refiner for further refining, a screen or other filter, or to the fiber processing machine, such as a paper machine, that processes the refined fiber 140 into a product.

Figure 6:
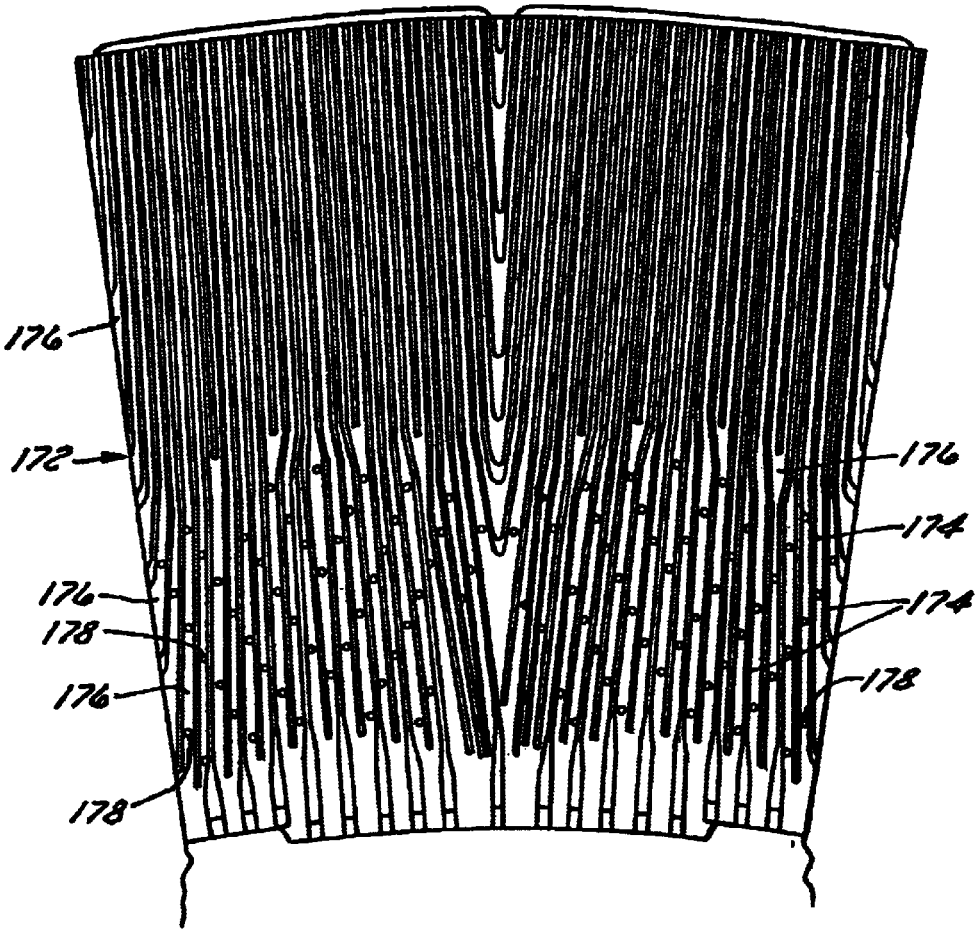
FIG. 6 is a front plan view of an exemplary refiner disk segment.

FIG. 6 depicts an exemplary segment 172 of a refiner disk that preferably is removable so it can be replaced, such as when it becomes worn. The segment 172 has a plurality of pairs of spaced apart upraised bars 174 that define grooves or channels 176 therebetween. The pattern of bars 174 and grooves 176 shown in FIG. 6 is an exemplary pattern as any pattern of bars 174 and grooves 176 can be used. If desired, surface or subsurface dams 178 can be disposed in one or more of the grooves 176.

During refining, fiber in the stock that is introduced between opposed refiner disks is refined by being ground, abraded, or mashed between opposed bars 174 of the disks. Stock disposed in the grooves 176 and elsewhere between the disks flows radially outwardly and can be urged in an axial direction by dams 178 to further encourage refining of the fiber. Depending on the construction, arrangement and pattern of bars 174 and grooves 176, differences in the angle between the bars 174 of opposed disks due to relative movement between the disks can repeatedly occur. Where and when such differences in angle occur, radial outward flow of stock between the opposed disks is accelerated or pumped. Where and when the bars 174 and grooves 176 of the opposed disks are generally aligned, flow is retarded or held back.

Figure 7:
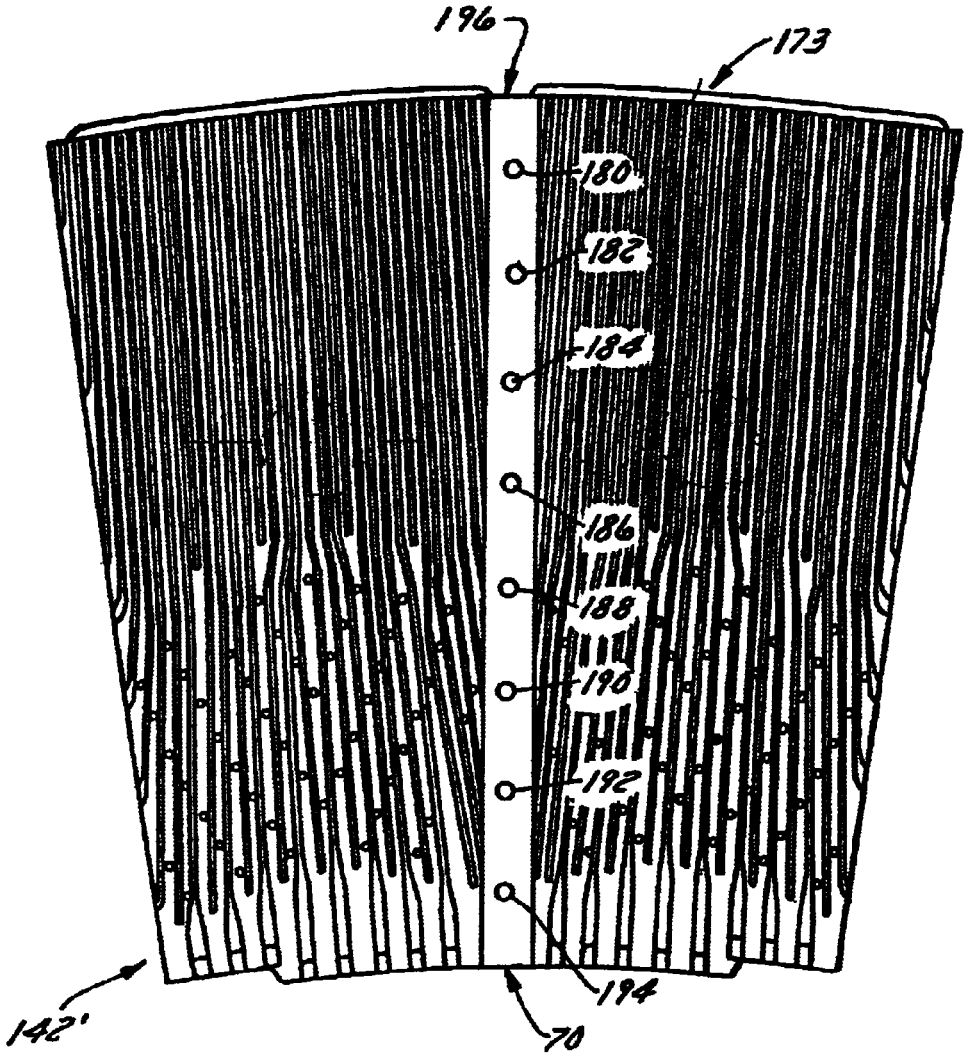
FIG. 7 is a front plan view of a refiner disk segment that has a plate with sensors used to sense a parameter, such as a process variable, in the refining zone.

Referring to FIG. 7, a portion of one refiner disk or a refiner disk segment 173 of refiner 32 contains a sensor device 70. The sensor device 70 includes at least one sensor capable of sensing at least one parameter in a refining zone during refiner operation. The sensed parameter can be used as the setpoint or can be used in its determination. In the embodiment shown in FIG. 7, the sensor device 70 is comprised of a sensor assembly 196 that has a plurality of spaced apart sensors 180, 182, 184, 186, 188, 190, 192, and 194. If desired, the sensor assembly 196 can have at least three sensors, at least four sensors, at least five sensors and can have more than eight sensors. Preferably, at least one refiner disk of each refiner 32 being monitored by processor 34 is equipped with a sensor device 70 and, where the refiner disc is segmented, the disc is equipped with at least one sensor segment 173.

In the sensor disk segment embodiment shown in FIG. 7, the sensors 180, 182, 184, 186, 188, 190, 192, and 194 are carried by a bar 198 received in a radial channel or pocket in the face of the segment. The bar 198 can be, for example, frictionally retained, affixed by an adhesive, welded, or retained in the disk or disk segment using fasteners. Each sensor 180, 182, 184, 186, 188, 190, 192, and 194 has at least one wire (not shown) to enable a signal to be communicated from the sensor to the signal conditioner and/or a data acquisition device. Where the segment 173 is carried by a rotor 120, a slip ring (not shown) can be connected to the wires connected to the sensors 180, 182, 184, 186, 188, 190, 192, and 194. Telemetry can also be used.

Figure 8:
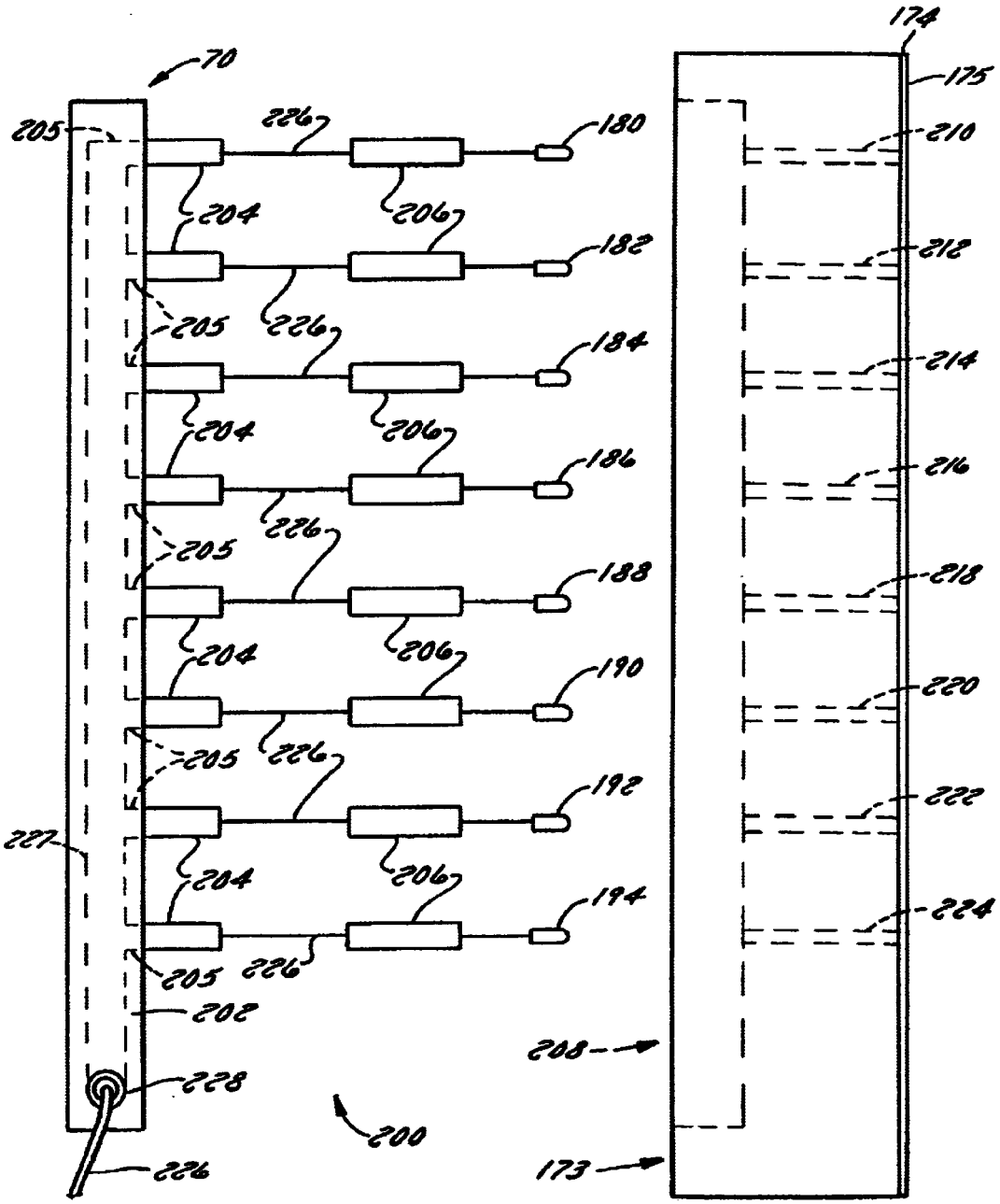
FIG. 8 is an exploded side view of a second refiner disk with sensors embedded in the refining surface of the disk.

In another preferred embodiment, FIG. 8 illustrates a different sensing assembly 200 that includes a manifold-like fixture 202 that can have a plurality of outwardly extending and tubular sensor holders 204. In a preferred embodiment, there are no sensor holders as at least part of each sensor 180, 182, 184, 186, 188, 190, 192, and 194 is received in a bore 205 (shown in FIG. 8 in phantom) in the fixture 202. The fixture 202 is disposed in a pocket 208 (shown in phantom in FIG. 8) in the rear of the sensor refiner disk segment 173.

When the disk segment 173 is assembled, each sensor 180, 182, 184, 186, 188, 190, 192, and 194 is received in its own separate bore 210, 212, 214, 216, 218, 220, 222, and 224 such that an axial end of each sensor is exposed to the refining zone during refiner operation. Each sensor 180, 182, 184, 186, 188, 190, 192, and 194 is at least partially received in a spacer 206 that spaces the sensor from the surrounding refiner disk material. At least where the sensor is a temperature sensor, the spacer 206 is an insulator that thermally insulates the sensor from the thermal mass of the refiner disk segment 173. A preferred insulating spacer 206 is made of ceramic, such as alumina or mullite.

When assembled to the segment 173, an axial end of each sensor 180, 182, 184, 186, 188, 190, 192, and 194 is disposed no higher than the axial surface 175 of the bars 174 of the disk segment 173. Preferably, the axial end of each sensor 180, 182, 184, 186, 188, 190, 192, and 194 is disposed at least about fifty thousandths of an inch below the axial surface 175 of the portion of the bar 174 adjacent the sensor. In one preferred embodiment, each sensor 180, 182, 184, 186, 188, 190, 192, and 194 is disposed at least one-hundred thousandths of an inch below the axial surface of the portion of the bar 174 adjacent the sensor.

When assembled, each sensor is telescopically received in one of the spacers 206, and the spacer 206 is at least partially telescopically received in one of the bores 205 in the fixture 202. Each sensor has at least one wire 226 that passes through one of the insulating tubes 206, one of the sensor holders 204, and through a hollow in the bar 202 until it reaches outlet 228 located adjacent one end of the bar 202. Although not shown, a sealant, such as silicone or a high temperature refiner plate potting compound, can be disposed in a hollow 227 in the fixture 202 to protect the wires 226 and prevent steam and stock from leaking from the refining zone. In another preferred embodiment, the fixture 202 is eliminated and replaced by a high temperature potting compound that seals and holds the wires 226 in place. Where the fixture 202 is used, it preferably is anchored to the segment 173 by an epoxy or potting compound.

In one preferred embodiment, at least one of the sensors 180, 182, 184, 186, 188, 190, 192, and 194 is a temperature sensor, such as an RTD, a thermocouple, or a thermistor. Where measurement of absolute temperature in the refining zone is desired, a preferred temperature sensor is a platinum RTD that has three wires.

Where only the relative difference in temperature is needed, other kinds of temperatures sensors can also be used. Suitable examples include platinum RTD temperature sensors; nickel, copper, and nickel/iron RTD temperature sensors; and thermocouples, such as J, K, T, E, N, R, and S thermocouples.

In another preferred embodiment, each of the sensors 180, 182, 184, 186, 188, 190, 192, and 194 is a pressure sensor, such as a ruggedized pressure transducer, which can be of piezoresistive or diaphragm construction and that is used to sense pressure in the refining zone. An example of a pressure transducer that can be used is a Kulite XCE-062 series pressure transducer marketed by Kulite Semiconductor Products, Inc. of One Willow Tree Road, Leonia, N.J.

In still another preferred embodiment, the sensing assembly 196 or 200 is comprised of a combination of pressure and temperature sensors. For example, sensing assembly 196 or 200 can be comprised of a single temperature sensor that senses temperature in the refining zone and a single pressure sensor that senses pressure in the refining zone. The sensing assembly 196 or 200 can also be comprised of a plurality of temperature sensors and a plurality of pressure sensors that sense temperature and pressure at different locations in the refining zone.

Figure 9:
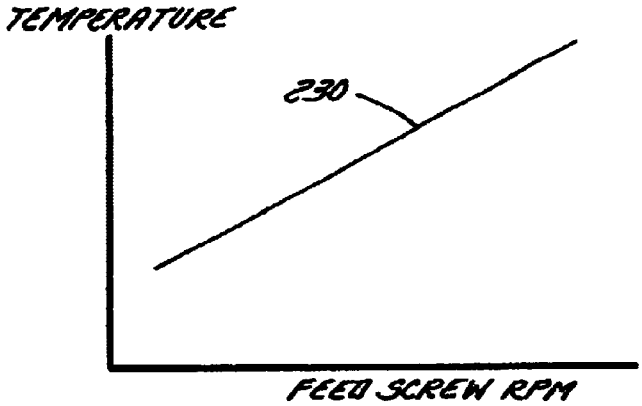
FIG. 9 is a graph showing a generally linear relationship between a process variable, namely refiner temperature, and the controlled variable, namely feed screw speed.
Figure 10:
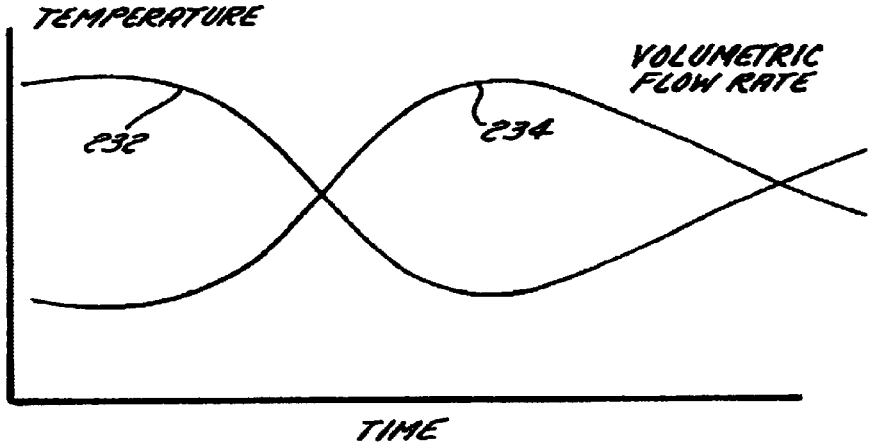
FIG. 10 is a graph depicting controlling the process variable, namely refiner temperature, by regulating the controlled variable, namely volumetric flow rate of stock entering the refiner.
Figure 11:
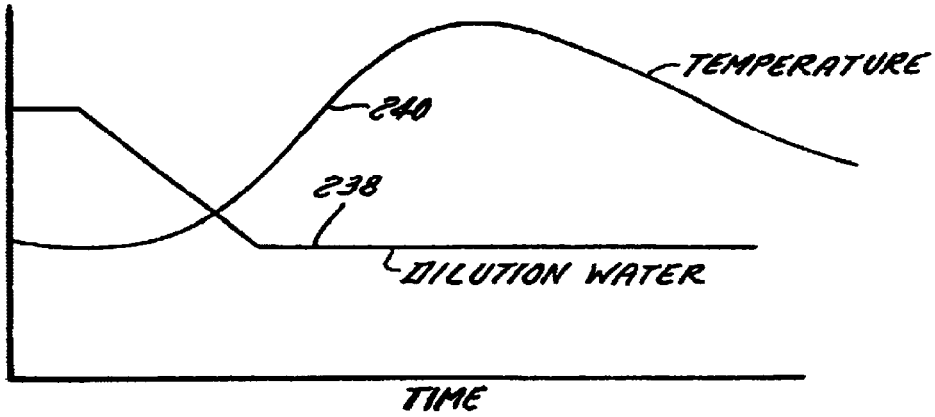
FIG. 11 is a graph illustrating the relationship between a process variable, namely refiner temperature, and a controlled variable, namely dilution water flow rate.

FIGS. 9–11 are directed to a method of controlling refiner operation. It has been long been assumed that a constant feed screw speed results in a constant volumetric flow rate of stock into a refiner and that a constant stock volumetric flow rate produces a constant mass flow rate of fiber into the refiner. However, it has been discovered that the fiber mass flow rate can vary even when the feed screw speed and volumetric flow rate of stock remain constant. It is believed that these variations in fiber mass flow rate that occur when the feed screw speed is constant are caused by variations in the density of the fiber in the stock, namely changes in wood density, by variations in chip size, by variations in chip moisture content, by feed screw wear over time, by process upsets that occur upstream of the refiner, and by other reasons that are often specific to the mill in which the refiner is installed.

It is thus believed that these variations are caused by changes in consistency of stock entering the refiner. A method of this invention measures consistency near or in the refining zone. Consistency measurement can then be used to adjust mass flow to help keep the consistency of stock entering the refiner constant or nearly constant. For example, where and when variations occur, changes can be very quickly made to stock in the refining zone to make the consistency of stock in the refining zone more constant or closer to a desired consistency setpoint. One preferred way of making a change is to adjust the flow of dilution water. Another preferred way is to change feed screw speed.

In one preferred control method, refiner operation is affected by controlling the volumetric flow rate of stock entering the refiner in accordance with determined consistency (process variable) that preferably is based on, at least in part, at least one parameter that relates to conditions in the refining zone. Refiner process control is achieved by adjusting the volumetric flow rate of stock in response to changes in consistency relative to its setpoint.

By regulating the volumetric flow rate of the stock to keep the fiber mass flow more stable, the fiber bundles in the stock are impacted with a more constant specific energy. This leads to more consistent refining intensity, which greatly reduces variations in motor load and pulp quality. Because variations in motor load are reduced, less energy is used during refining.

In another preferred control method, refiner operation is affected by controlling the flow rate of dilution water entering the refiner in accordance with measured consistency that preferably is also based on, at least in part, at least one parameter that relates to conditions in the refining zone. Refiner process control is achieved by adjusting the rate of flow of dilution water in response to changes in consistency relative to its setpoint.

When either or both control methods are implemented in a primary refiner, variation in pulp quality measured as freeness, long fiber content, shives, etc. (CSF) can be reduced, the occurrence of shives can be reduced, load swings can be decreased, clashing of refiner disks can lessen, and a more uniform fiber distribution preferably is produced. When implemented in a secondary refiner, refiner load is more stable, the energy required for a given CSF target can be reduced, and the reject rate can be decreased. The result is lower Kraft usage and more consistent pulp quality that produces a fiber product with better and more consistent tear, tensile, burst, and drainage characteristics.

FIG. 9 is a graph with a line 230 that shows a generally linear correlation between a process variable and the volumetric flow rate of stock entering the refiner. In the case of the graph shown in FIG. 9, the process variable is a temperature in the refining zone. The correlation strongly shows that, with all else remaining the same, the temperature in the refining zone substantially linearly increases with increasing volumetric flow rate of the stock resulting from increasing the speed of the feed screw. This correlation also holds true for pressure in the refining zone, as well as for the temperature at the refiner inlet and outlet.

There is also a generally linear correlation between the dilution water flow rate and consistency. As dilution water flow rate is increased, consistency decreases and vice versa.

FIG. 10 is a second graph of a pair of curves that depicts an inverse relationship between a process variable 232 and volumetric flow rate 234. In the case of the graph shown in FIG. 10, the process variable is temperature. FIG. 10 illustrates that when temperature drops, it can be increased by increasing the speed of the feed screw to increase the volumetric flow rate of stock entering the refiner. If it is assumed that the consistency of the stock entering the refiner remains constant, increasing the volumetric flow rate will generally increase the temperature (and pressure) in the refining zone and at the refiner inlet and the refiner outlet.

FIG. 11 is a third graph of a pair of curves that shows the relationship between the flow rate of dilution water 238 and a process variable 240 that preferably is a refining zone temperature. As dilution water flow rate is reduced, the temperature in the refining zone rises and vice versa. Thus, dilution water flow rate can be controlled to regulate refiner temperature. Dilution water flow rate can be controlled in addition to or in combination with the feed screw speed.

Figure 12:
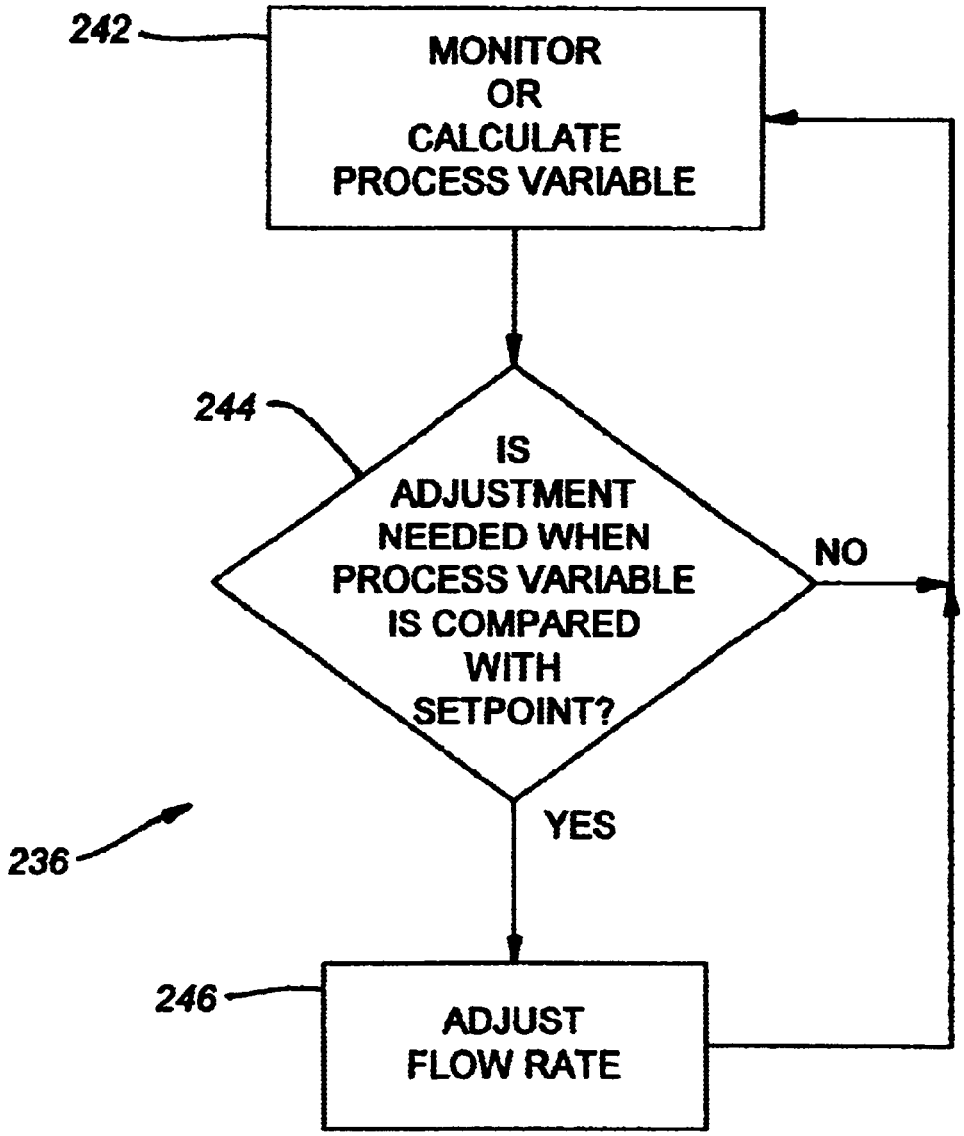
FIG. 12 is a flowchart illustrating a preferred method of controlling refiner operation.

FIG. 12 schematically depicts a preferred embodiment of the refiner control method 236. During operation, the processor 34 monitors refiner operation and obtains a process variable 242.

During operation, the processor 34 monitors a number of refiner parameters including main motor power, dilution water flow rate, and refiner disk pressure (hydraulic pressure). At least one of other parameter that is monitored is a parameter that relates to conditions in the refining zone. One preferred parameter is a temperature in the refining zone that can be an absolute temperature. Another preferred parameter is a pressure in the refining zone that can be an absolute pressure. If desired, other parameters can also be monitored including refiner inlet and outlet temperatures and/or pressures. If desired, pressures and temperatures can both be monitored.

In one preferred embodiment, the process variable is a monitored parameter, such as a refining zone temperature and pressure. The process variable can also be a refiner inlet or outlet temperature or pressure. In another preferred embodiment, the process variable is calculated using one of these monitored parameters.

In step 244, the process variable is compared with the setpoint to determine whether to adjust the volumetric flow rate of stock in step 246. In one preferred implementation, the process variable is compared with the setpoint, and the volumetric flow rate is adjusted up or down depending on whether the process variable is greater than or less than the setpoint.

Figure 13:
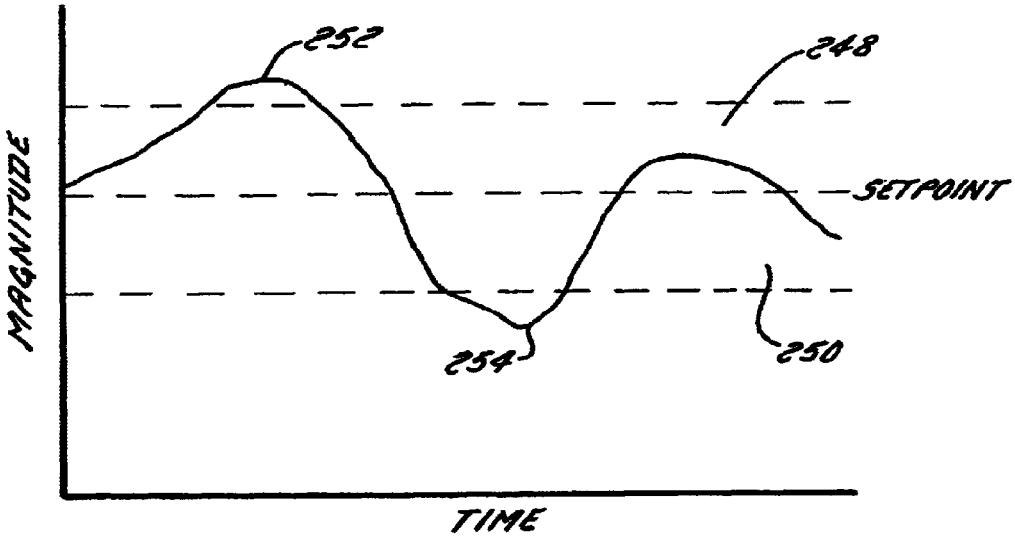
FIG. 13 is a graph depicting a tolerance or band around a process variable setpoint used in controlling refiner operation.

Referring to FIG. 13, in another preferred implementation, the process variable is compared with the setpoint and the volumetric flow rate is adjusted if the process variable falls outside a first band 248 that lies above the setpoint and a second band 250 that lies below the setpoint. Where the process variable falls outside band 248, such as where indicated by reference numeral 252, the volumetric flow rate of stock is increased or decreased to bring the process variable back within the band. Likewise, where the process variable falls outside band 250, such as where indicated by reference numeral 254, the volumetric flow rate of stock is conversely increased or decreased to bring the process variable back within the band.

Figure 14:
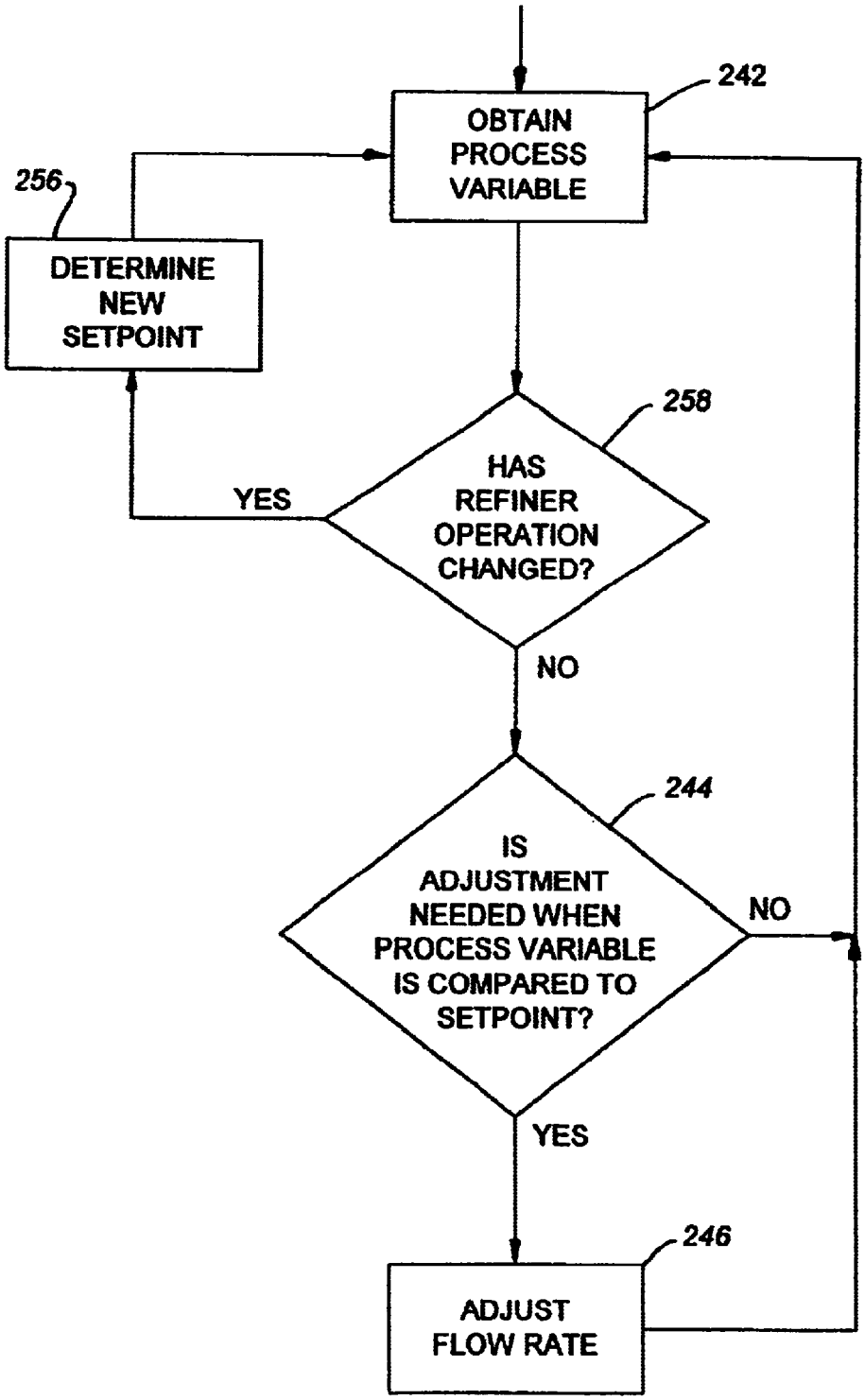
FIG. 14 depicts one preferred implementation of the control method.

FIG. 14 depicts an implementation of the control method where a new setpoint is determined at step 256 when it has been determined that refiner operation has been changed in step 258. For example, should an operator change some particular aspect of refiner operation, a new setpoint will be determined. A new setpoint will also be determined if the aspect of refiner operation that was changed was done so automatically. For example, where there is a DCS linked to the refiner, the DCS can change some aspect of operation, such as main motor speed, that will cause a new setpoint to be determined.

After the new setpoint has been determined, at step 256, the controller 236 will resume obtaining the process variable and the rest of the algorithm shown in FIG. 14 will be carried out. To permit the refiner operation to stabilize, preferably, some time passes before the new setpoint is determined.

Figure 15:
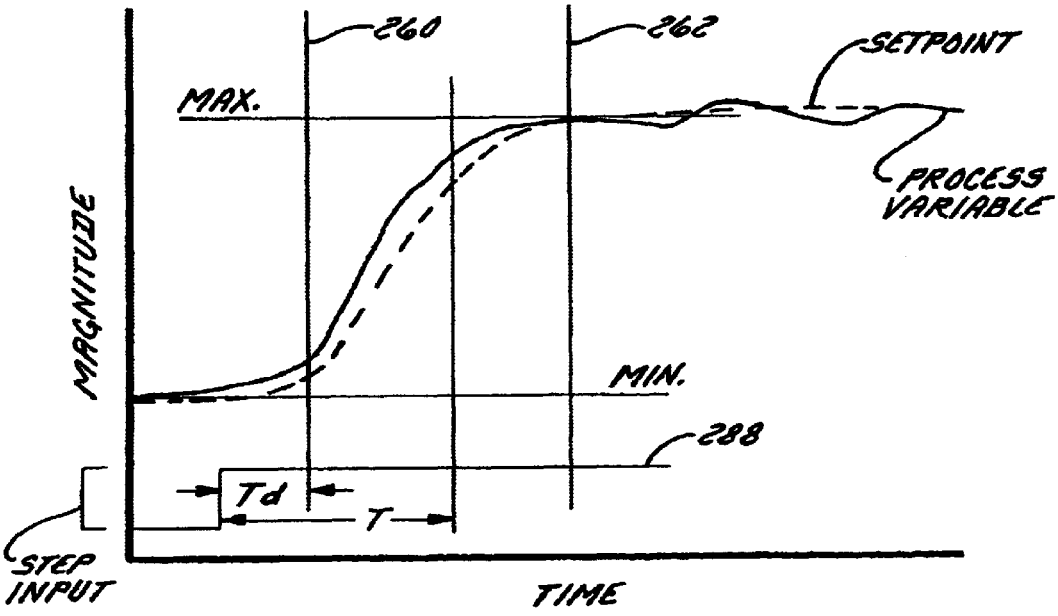
FIG. 15 is a graph illustrating a method of changing a process variable setpoint in response to a change in refiner operation.
Figure 16:
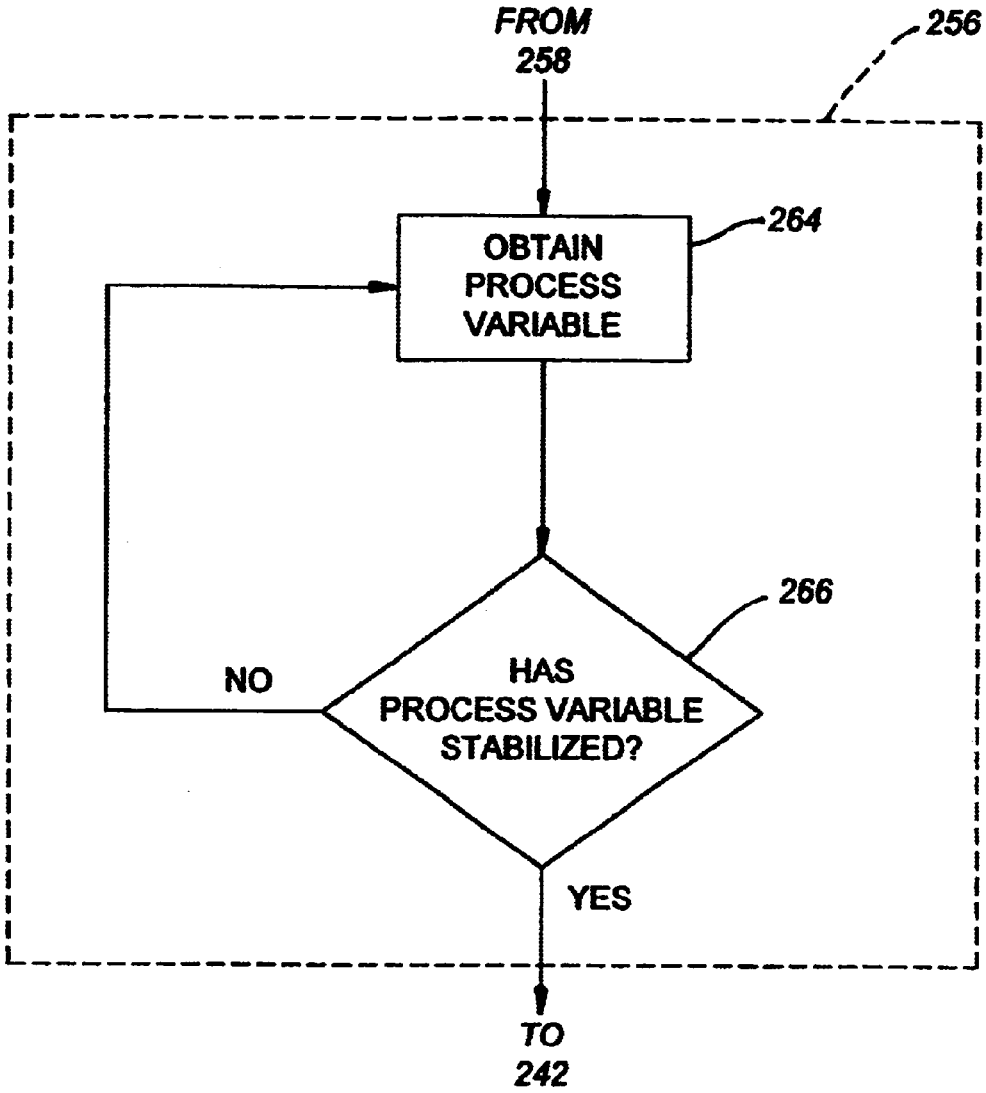
FIG. 16 is a schematic of a method of changing the setpoint in response to a change in refiner operation.

FIGS. 15 and 16 illustrates a preferred method of determining a new setpoint. The first vertical line labeled reference numeral 260 represents when refiner operation has been changed. The second vertical line labeled reference numeral 262 represents when the refiner operation has stabilized after the change, and the new setpoint has been determined. Referring to FIG. 16, in one preferred implementation, the process variable is obtained in step 264, and the process variable obtained is analyzed to determine whether its magnitude over time has stabilized in step 266. In determining whether refiner operation has stabilized, successive process variables are analyzed to determine whether their change in slope is less than 5%. In another method of determining whether refiner operation has stabilized, each process variable of a current cycle is compared to its value from the prior cycle for a number of cycles that can be two cycles in number, three cycles in number, or more. If the absolute value of the average of the current process variable value and its prior value for at least two cycles is compared, the process will be deemed converged, i.e., steady state, if the averages fall within some acceptable tolerance. For example, where three consecutive temperatures are 171.5°, 170.5°, and 170.0°, and the tolerance 0.5°, convergence will not have occurred because the absolute value of the averages will not have fallen with the 0.5° tolerance. In another example, where the three consecutive temperatures are 170.5°, 170.0°, and 170.0°, and the tolerance 0.5°, convergence will have occurred because the absolute value of the averages will have fallen with the 0.5° tolerance. When it has been determined that refiner operation has stabilized, the controller is released, and its control over mass flow resumes.

Figure 17:
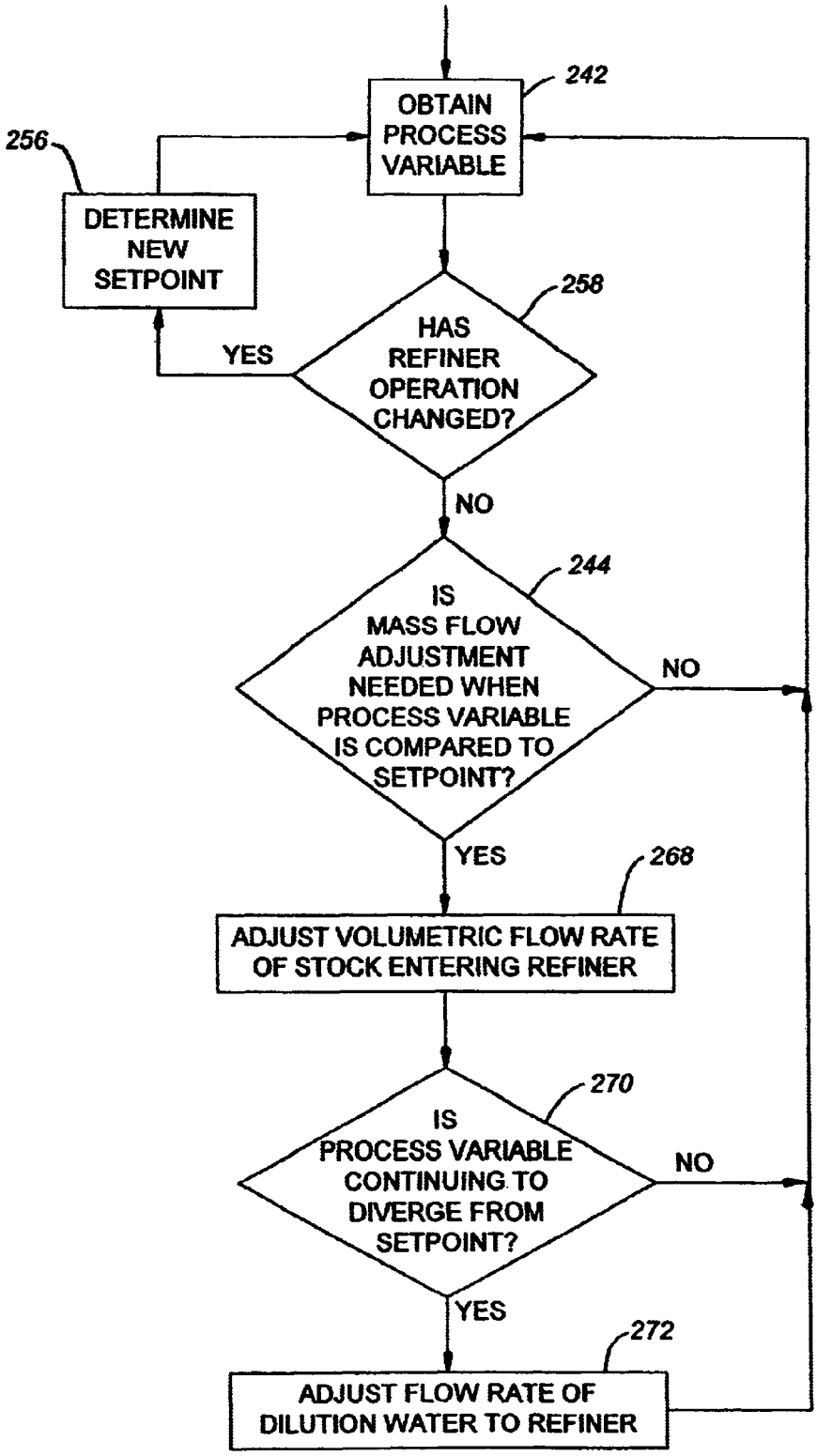
FIG. 17 is a schematic depicting a second preferred implementation of the control method.

FIG. 17 illustrates another flow chart of another preferred controller implementation. If it is determined in step 244 that an adjustment to mass flow is needed, the volumetric flow rate of the stock entering the refiner 32 is adjusted in step 268. For example, if the process variable has dropped below the setpoint such that adjustment is needed, the volumetric flow rate of stock entering the refiner 32 can be appropriately increased or decreased. If the process variable has risen above the setpoint such that adjustment is needed, the volumetric flow rate of stock entering the refiner 32 can be appropriately conversely increased or decreased.

As an example, where the process variable is a refiner temperature, such as temperature in the refining zone, the volumetric flow rate will be increased if the temperature has risen far enough from a setpoint temperature such that adjustment is needed. The volumetric flow rate will be decreased if the temperature has dropped far enough below the setpoint temperature such that adjustment is needed.

Changing the volumetric flow rate preferably is accomplished by speeding up or slowing down the feed screw. Increasing the feed screw speed will increase the volumetric flow rate, and decreasing the feed screw speed will decrease the volumetric flow rate.

In some instances, changing the volumetric flow rate of stock entering the refiner will not have the desired affect of converging the process variable to its setpoint. This failure can be caused by changes in the mass flow rate of fiber entering the refiner that occur independently of the volumetric flow rate of the stock. It is believed that this occurs because the density of the fiber in the stock has changed, chip size has changed, chip moisture content has changed, the feed screw has become worn over time, process upsets have occurred upstream of the refiner that affect fiber mass flow, or due to other reasons that are often specific to the mill in which the refiner is installed.

To account for the possibility of the fiber mass flow rate changing independent of the volumetric flow rate of the stock, step 270 determines whether the process variable continues to diverge from the setpoint despite the volumetric flow rate of the stock having been adjusted in step 268. If it is determined that the process variable is diverging from the setpoint too much, the flow rate of the dilution water is adjusted in step 272.

For example, where the process variable continues to diverge despite adjustment of the stock mass flow rate by a certain amount or by a certain percentage, the dilution water flow rate will be changed. For example, if the process variable continues to diverge and goes outside of an acceptable band, the dilution water flow rate can be changed. Hence, if the process variable is greater than or less than the setpoint by a certain percentage, such as 5%, the dilution water flow rate can be adjusted.

The dilution water flow rate is increased or decreased depending on the direction of convergence of the process variable. Where the process variable is a refiner temperature, such as a temperature in the refining zone, the dilution water flow rate is increased if the temperature increases above the setpoint and continues to diverge from the setpoint such that dilution water flow rate adjustment is needed. Conversely, the dilution water flow rate is decreased or stopped if the temperature decreases below the setpoint and continues to diverge unacceptably from the setpoint. This relationship also holds true for refiner pressure, such as a pressure in the refining zone.

Figure 18:
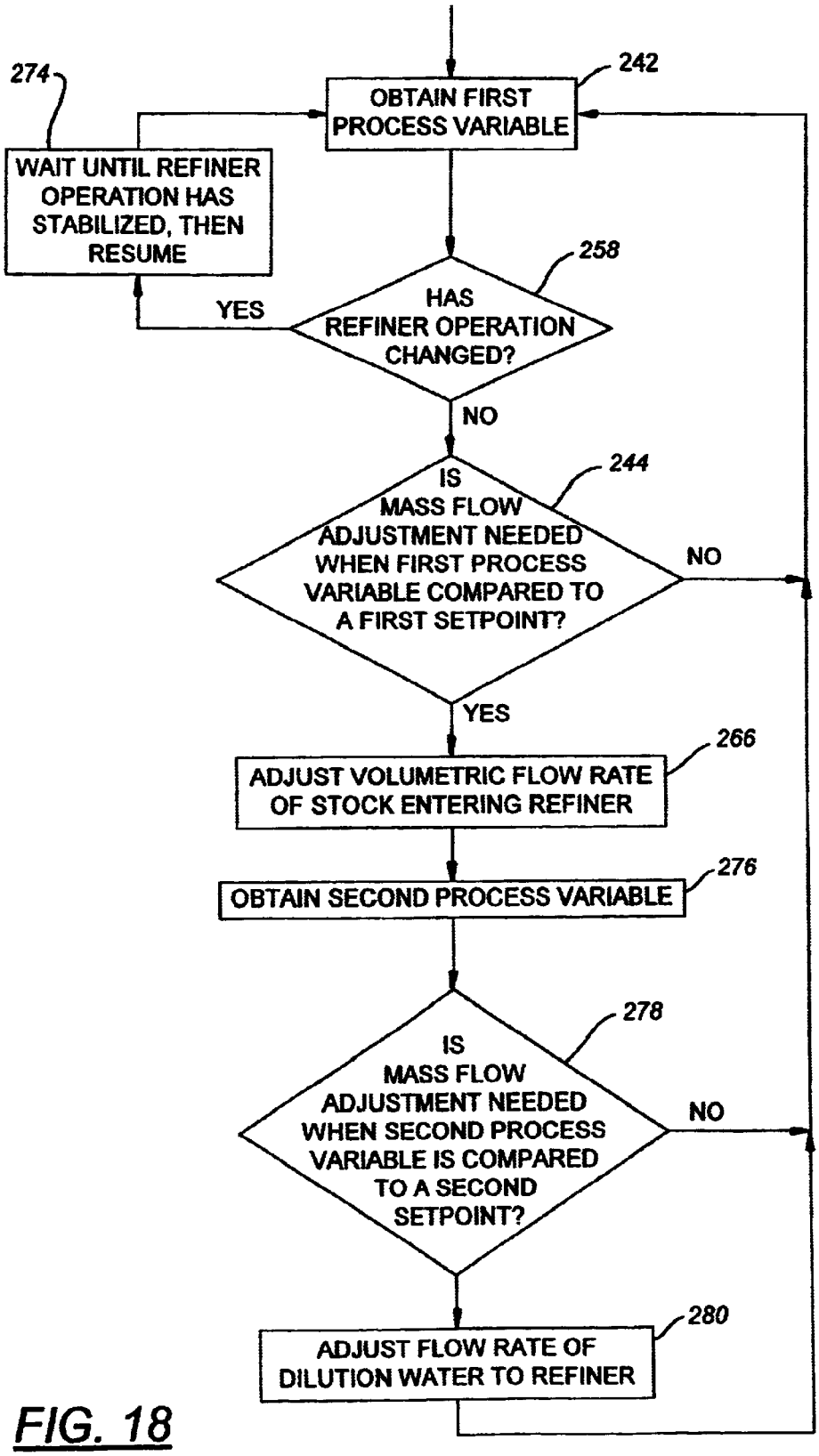
FIG. 18 is a schematic depicting a preferred implementation of the control method using two control loops that have two process variables that can be different.

FIG. 18 illustrates a still further preferred implementation of the control method. A first process variable is obtained in step 242. It is determined whether refiner operation has changed in step 258. If so, control is put on hold in step 274 until refiner operation stabilizes. Step 258 is not order dependent and can be performed anytime during execution of the control algorithm depicted in FIG. 18.

The first process variable and/or a second process variable can both be monitored to determine when one, the other, or both have reached a steady state value, such as in the manner depicted in FIGS. 15 and 16. When it has been determined that one or both process variables have reached a steady value, the steady state value is taken as the new setpoint and control resumes.

If refiner operation has not changed, the first process variable is compared against its setpoint in step 244 to determine whether the volumetric flow rate of stock entering the refiner should be adjusted. If so, the volumetric flow rate of the stock is changed in step 266. If not, the control algorithm branches to step 242 where the first process variable is once again obtained.

If the volumetric flow rate of the stock has been adjusted, a second process variable is obtained in step 276. If desired, both process variables can be determined at the same time or in a common control algorithm step.

The second process variable is compared against its setpoint in step 278 to determine whether an additional mass flow rate adjustment is needed. If so, the additional flow rate adjustment is performed in step 280. Preferably, the flow rate adjustment performed is an adjustment of the flow rate of dilution water to the refiner. If no flow rate adjustment is required, the control algorithm returns to obtain one or both process variables.

Figure 19:
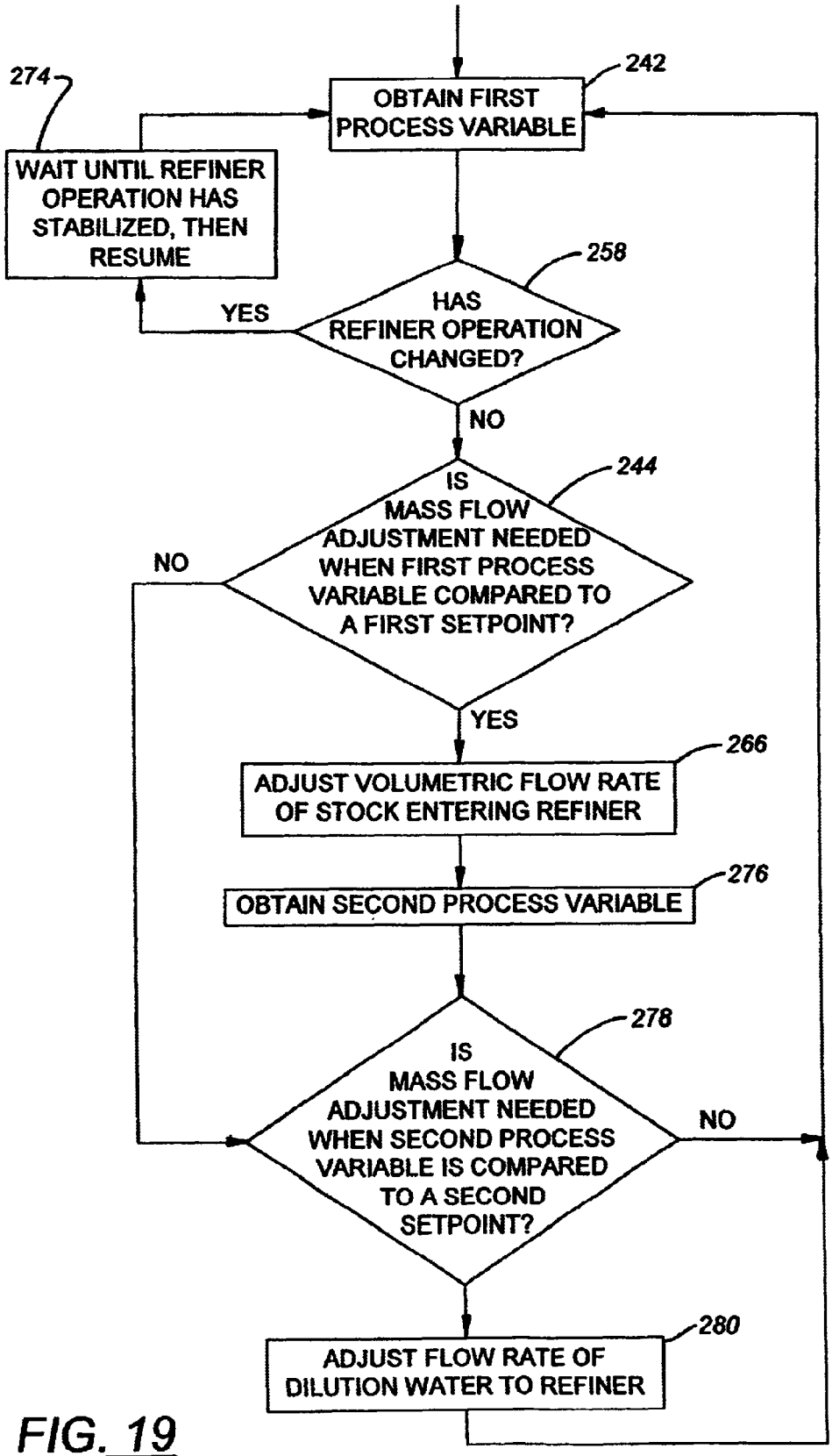
FIG. 19 is a schematic depicting a second preferred implementation of the control method using two control loops.

The control algorithm implementation depicted in FIG. 19 is similar to the control algorithm depicted in FIG. 18 except that the second process variable is compared against its setpoint in step 278 even if it has been determined that no mass flow rate adjustment is needed in step 244. This arrangement enables, for example, two control loops to be executed at the same time. It also enables two completely independent control loops to be used.

In one preferred implementation of the control algorithms depicted in FIGS. 18 and 19, the first process variable preferably is a refiner temperature or a refiner pressure and the second process variable preferably is consistency. Where refiner temperature and/or pressure are used as a process variable, a temperature or pressure in the refining zone preferably is obtained.

Figure 20:
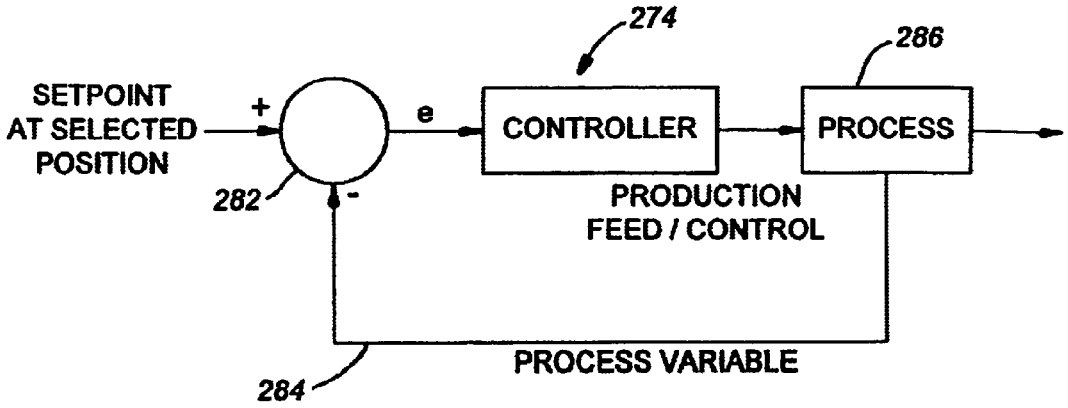
FIG. 20 is a control block diagram depicting one preferred implementation of the control method.

FIG. 20 illustrates a control block diagram of a preferred controller 274 that can be used with any of the preferred implementations previously discussed. While the controller can be a proportional controller, it preferably has at least a proportional component and an integral component. Where it is desirable to, for example, use feedforward control, the controller 274 can also have a derivative component.

At summing junction 282, the setpoint at the selected set of refiner operation conditions is summed with a process variable from a feedback loop 284 that is obtained from some parameter relating to the process 286 being controlled, namely refiner operation. The result of the summing junction produces e, which is set forth below:

$$e=SP-PV \qquad \text{(Equation I)}$$

where e is the error, SP is the value of the setpoint, and PV is the value of the process variable.

The equation that expresses the controller action is as follows:

$$u(t) = K_c\left(e + \frac{1}{T_i}\int_0^t e\,dt + T_d\frac{de}{dt}\right) \qquad \text{(Equation II)}$$

where u(t) is the controller output, $K_c$ is the controller gain, $T_i$ is the integral time constant in minutes, and $T_d$ is the derivative time constant in minutes. The proportional action of the controller can be expressed by the equation:

$$u_p(t)=K_c e \qquad \text{(Equation III)}$$

where $u_p(t)$ is the output of this portion of the controller. The integral action of the controller can be expressed by the equation:

$$u_I(t) = \frac{K_c}{T_i}\int_0^t e\,dt \qquad \text{(Equation IV)}$$

where $u_I(t)$ is the output of this portion of the controller. Where present, the derivative action of the controller can be expressed by the equation:

$$u_D(t) = K_c T_d\frac{de}{dt} \qquad \text{(Equation V)}$$

where $u_D(t)$ is the output of this portion of the controller.

The controller output, u(t), gets communicated as a control signal to the particular component being regulated by the controller. For example, where the component being regulated is the volumetric flow rate of stock, the control signal can be sent directly to a feed screw motor or motor controller that controls the feed screw speed. Where the system includes DCS, the signal preferably is sent to the DCS and causes the DCS to adjust the feed screw speed. Where the component is dilution water flow rate, the signal can be sent directly to a dilution water pump motor or motor controller that controls the dilution water pump. Where the system includes a DCS, the signal preferably is sent to the DCS and causes the DCS to adjust the dilution water flow rate. If desired, the output, u(t), can be processed further to produce the control signal or otherwise used in obtaining the control signal.

Because each refiner, stock system arrangement, and fiber processing plant is different, it is believed very likely that the controller will have to be tuned for the particular refiner it will be used to control. One preferred tuning method subjects the refiner to a step input and analyzes the response.

More specifically, the controller is tuned to determine the controller gain, $K_c$, the integral time constant, $T_i$, and, where a derivative component is used, the derivative time constant, $T_d$, by analyzing system response in response to a step input. In one preferred controller, the controller is a proportional-integral controller that has no derivative control component.

For example, where the controller output, u(t), is used to control the volumetric flow rate of stock entering the refiner and the refiner temperature is the process variable, the parameters $K_c$, $T_d$, and $T_i$, can be determined by increasing the volumetric flow rate of stock by a step input of a specific magnitude and then monitoring how fast it takes for the refiner temperature to begin increasing, as well as how long it takes until before the temperature reaches a steady state condition and its magnitude at steady state. This information is used in determining the dead time, $T_{DEAD}$, of the system, the time constant, $T_i$, the process gain, K, and the controller gain, $K_c$. The dead time, $T_{DEAD}$, is used to determine the controller gain, $K_c$, and can be used to determine the time constant, $T_i$.

Where the output, u(t), is used to control the dilution water flow rate entering the refiner and consistency is the process variable, the parameters $K_c$, $T_d$, and $T_i$, can be determined by increasing the dilution water flow rate by a step input of a specific magnitude and then monitoring how fast it takes for the consistency to begin decreasing, as well as how long it takes until before the consistency reaches a steady state condition. The magnitude of the consistency at steady state is also determined. This information is used in determining the dead time, $T_{DEAD}$, of the system, the time constant, $T_i$, the process gain, K, and the controller gain, $K_c$.

In one preferred embodiment, the process variable is refiner temperature and the output of the controller is used to set the speed of the feed screw to control the flow rate of stock entering the refiner. The controller must be tuned for the specific refiner and fiber processing plant in which the refiner is installed.

In one preferred method of tuning the controller, the system dead time, $T_{DEAD}$, the time constant, $T_i$, of the system, and the process gain, K, are determined. In tuning the controller, the refiner is operated normally at a particular set of operating conditions until steady state operation is achieved. Referring to FIG. 15, where the feed screw speed is the controlled variable 288, the speed is then adjusted upwardly or downwardly by an amount (represented by the step in FIG. 15) that preferably is measured. Then, the time it takes from the moment of the adjustment for the change in feed screw speed (controlled variable) until temperature (process variable) is affected is measured. This amount of time, the lag between changing the output and the change affecting the process variable, is the dead time, $T_{DEAD}$.

Where refiner temperature is the process variable and the feed screw speed is being controlled, $T_{DEAD}$ can be as little as one second to as much as about two minutes, depending on the refiner, how far the feed screw is located from the refiner, and other factors. Typically, $T_{DEAD}$ is between about five seconds and about fifty seconds. Where consistency is the process variable and the dilution water flow rate is being controlled, $T_{DEAD}$ is less and typically is between one half second and five seconds.

Referring once again to FIG. 15, the time constant, $T_i$, is determined by measuring the time it takes for the process variable to reach about ⅔ (about 63.2%) of the difference between its minimum value and its maximum steady state value. Where temperature is the process variable and volumetric flow rate (feed screw speed) is the controlled variable, the time constant, Ti, ranges between 0.3 minute and 1.1 minute. Typically, the time constant, $T_i$, ranges between about 0.4 minute and about 0.75 minute. Where consistency is the process variable and dilution flow rate is the controlled variable, the time constant, $T_i$, is smaller and typically less than about 0.3 minute.

The controller gain, $K_c$, is determined or selected. $K_c$ preferably ranges between about 0.25 and about 2. Where the controller is a PID controller, the derivative time constant, $T_d$, can be set approximately equal to a rate of change of the process variable after the dead time has passed but before it has reached steady state.

In one preferred method of determining $K_c$, the process gain, K, is first determined and then used, along with the dead time, $T_{DEAD}$, and the time constant, $T_i$, to determine $K_c$. Referring to FIG. 15, K is the ratio of the change (or percent change) in the magnitude of the step input over the change (or percent change) in the magnitude of the output, i.e., max−min.

Where the controller is a PI controller, the following equation can be used to determine the proportional band, PB, in percent:

$$PB = 110\frac{KT_{DEAD}}{T_i} \quad \text{(Equation VI)}$$

The coefficient of 110 can be varied depending on the characteristics of the controller desired. The controller gain, Kc, is then determined using the following equation:

$$K_c = \frac{100}{PB} \quad \text{(Equation VII)}$$

Where this method is used, the following equation can be used to determine the time constant, $T_i$, in minutes:

$$T_i = 3.33T_{DEAD} \quad \text{(Equation VIII)}$$

Where the controller is a PID controller, the following equation can be used to determine the proportional band, PB, in percent:

$$PB = 80\frac{KT_{DEAD}}{T_i} \quad \text{(Equation IX)}$$

The coefficient of 110 can be varied depending on the characteristics of the controller desired. The controller gain, Kc, is determined in the manner set forth above in Equation VII. The following equation can be used to determine the integral time constant, $T_i$, in minutes:

$$T_i = 2.00T_{DEAD} \quad \text{(Equation X)}$$

The following equation can be used to determine the derivative time constant, $T_d$, in minutes:

$$T_d = 0.50T_{DEAD} \quad \text{(Equation XI)}$$

Figure 21:
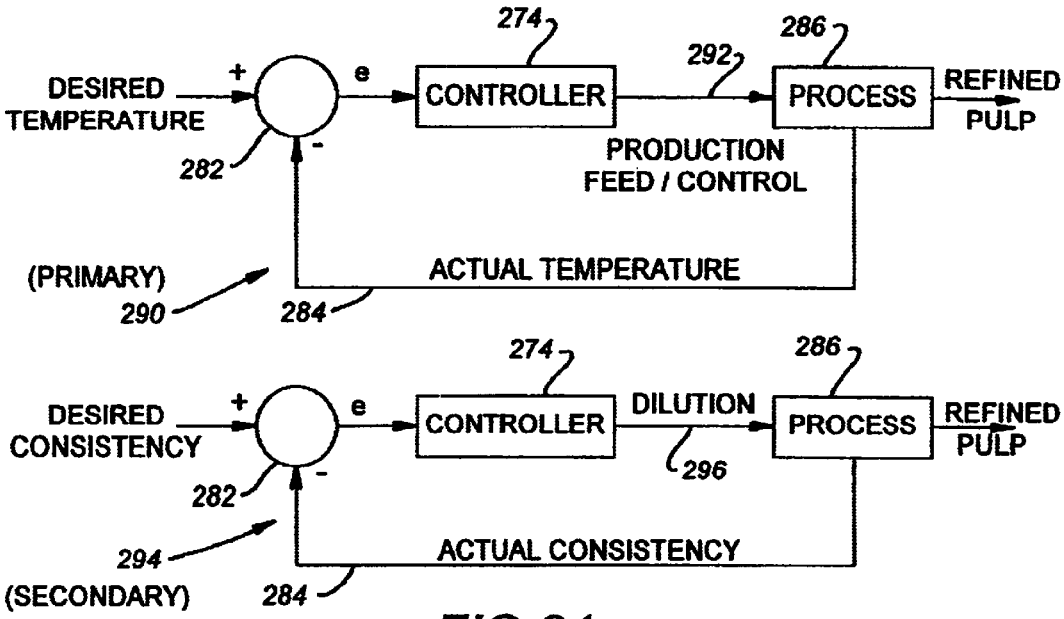
FIG. 21 is a control block diagram depicting a second preferred implementation of the control method having two control loops.

FIG. 21 depicts a pair of the controllers 274 that control the same refiner. The process of the refiner being monitored in one controller arrangement, referred to by reference numeral 290, is an actual refiner temperature, preferably a temperature in the refining zone. Where there is more than one sensor, such as sensors 78, 180, 182, 184, 186, 188, and 190, from which an actual refining zone temperature can be obtained and used as the process variable 284, the refining zone temperature can be an average temperature, the temperature of a single selected sensor, or a temperature of the refining zone obtained using another method.

The actual temperature is summed at 282 with a desired temperature setpoint to obtain the process error value, e. The process error value, e, is fed into the controller 274. The controller 274 outputs a signal that is used to regulate the speed of the feed screw to regulate the volumetric flow rate of stock entering the refiner. Where the actual temperature has risen above the desired temperature, the controller 274 will output a signal 292, labeled "Production Feed/Control" in FIG. 21, that will decreases the speed of the feed screw to lessen the volumetric flow rate. Where the actual temperature has dropped below the desired temperature, the controller 274 will output a signal 292 that increases the speed of the feed screw to increase the volumetric flow rate.

The process variable of the refiner being monitored in the other controller arrangement, referred to by reference numeral 294, is a consistency measurement, referred to in FIG. 21 as "Actual Consistency." The measured consistency is summed at 282 with a desired consistency setpoint to obtain the process error value, e. The process error value, e, is fed into the controller 274. The controller 274 outputs a signal 296 that is used to control operation of the dilution water pump to regulate the flow rate of dilution water entering the refiner. Where the measured consistency has risen above the desired consistency, the controller 274 will output a signal 296, labeled "Dilution" in FIG. 21, that will increase the dilution water pump output to increase the dilution water flow rate. Where the actual consistency has dropped below the desired consistency, the controller 274 will output a signal 296 that decreases or stops the dilution water pump to thereby reduce the dilution water flow rate.

In another preferred method, the measured consistency is the process variable and the controller output is a control signal that controls or is used to control the feed screw speed to control the volumetric flow rate of stock entering the refiner. In a still further preferred method, at least one measured temperature, e.g., the actual temperature, in the refining zone is the process variable and the controller output is a control signal that controls or is used to control the flow of dilution water.

Where the refiner is a twin refiner, the first controller arrangement 290 preferably is used to control the volumetric mass flow rate of stock entering a primary refiner of the twin refiner. The process variable measured is temperature in a refining zone of the primary refiner. The second controller arrangement 294 is used to control the flow rate of dilution water into a secondary refiner of the twin refiner. The process variable measured is the consistency of the stock at the output of the primary refiner or the inlet of the secondary refiner of the twin refiner. Where consistency is measured in the refining zone, it can be measured in a refining zone of the primary refiner or the secondary refiner. Where consistency is measured in a refining zone of the secondary refiner, it preferably is measured adjacent where the stock enters the refining zone.

Where consistency is the process variable, the consistency is measured of the stock entering the refiner. In such an instance, temperature and/or pressure sensor(s) preferably are located in the refiner such that it can measure the consistency of the stock before or when it enters a refining zone or when it is in a refining zone.

Referring additionally to FIGS. 23–30, in one preferred method of measuring or determining consistency, refiner temperature or pressure measurements are used along with measurements of other refiner parameters to measure consistency. This novel method of determining consistency and system used to determine consistency is based on an application of mass and energy balance to the pulp as it flows through the refiner 32. Moisture in the refiner 32 is assumed to be an equilibrium mixture of water and steam, and the temperature (and therefore, pressure) of the water-steam mixture is assumed to vary with radial position in the refiner 32. Steam is assumed to be saturated throughout the refining zone.

The inputs required for the computation of consistency include the temperature within the refiner zone (or pressure), the distribution of the motor load (specific power) within the refining zone, and an initial consistency. Initial consistency can be an assumed value or provided in a conventional manner. In one preferred implementation, initial consistency is an estimated value. As an output, consistency is provided as a function of radial position in the refiner.

The consistency determination procedure set forth below is well suited for use in controlling refiner operation, since the refining zone temperature, refiner load, dilutions, hydraulics and other refiner parameters are measured in real time. Using this method of determining consistency in real time, monitoring and/or controlling refining zone consistency as a function of both time and space (e.g., location in the refining zone) can be done. Consistency can be quickly measured in no more than five minutes and preferably is measured in real time. In one preferred embodiment, consistency is measured a plurality of times a second and preferably at a rate of twenty times a second.

A challenge in the refining industry is that quality needs to be improved and production costs need to be reduced. This has been true for the TMP process almost since its introduction some 30 years ago. However, today the challenge that lies ahead for the TMP process is even more real because of the increased supply of DIP, its relatively low value, and the restructuring of the market place. The reality is that only the strongest and most efficient installations will survive as the $21^{st}$ century begins.

Efficiency can be improved significantly by reducing the variation in important process parameters such as applied specific energy. By reducing the variations in the process, the resulting variations in pulp and paper quality will be reduced as well.

The advancement in computer technology and computational techniques has furthered knowledge of the refining process. Using proprietary software in conjunction with specially developed sensors, a refining modeling technology has been developed which is based on fundamental laws.

This technology is now used in real time for control purposes, and with the use of the above identified sensor refiner plate 173, an example of which is shown in FIG. 7, with one or more embedded sensors 180–194, significant process improvements are achieved.

Using a method and system of this invention, temperature and/or pressure measurements can be made and preferably are made in real time. Preferably, measurements can be made at a rate of at least one every five minutes and preferably a plurality of times per second or faster. Using a method and system of this invention, control changes can be made and preferably are made to the refiner 32 in real time. Preferably, they can be made at a rate of at least one every five minutes and preferably faster. For example, in one preferred embodiment, real time control of the refiner 32 is achieved. Preferably, the system and method enables a plurality of the aforementioned setting changes to be made per second and as fast as at a rate of about twenty hertz.

A refiner control method of this invention reduces the process and quality variations in commercial size disc refiners. The theory behind the control system will be explained first, followed by a system description. The discussion concludes with a discussion on the impact of important process parameters on the resulting pulp quality.

The concept of control system shown in the drawing figures is to enhance the performance of a disc refiner 32 through controlled refining operation. See, e.g., FIGS. 1–5, 7, 12–22, and 27. This is accomplished by expanding existing refiner plate technology to include sensors, which can be used to describe and control the refining conditions as a function of time and space (e.g., location).

Figure 23:
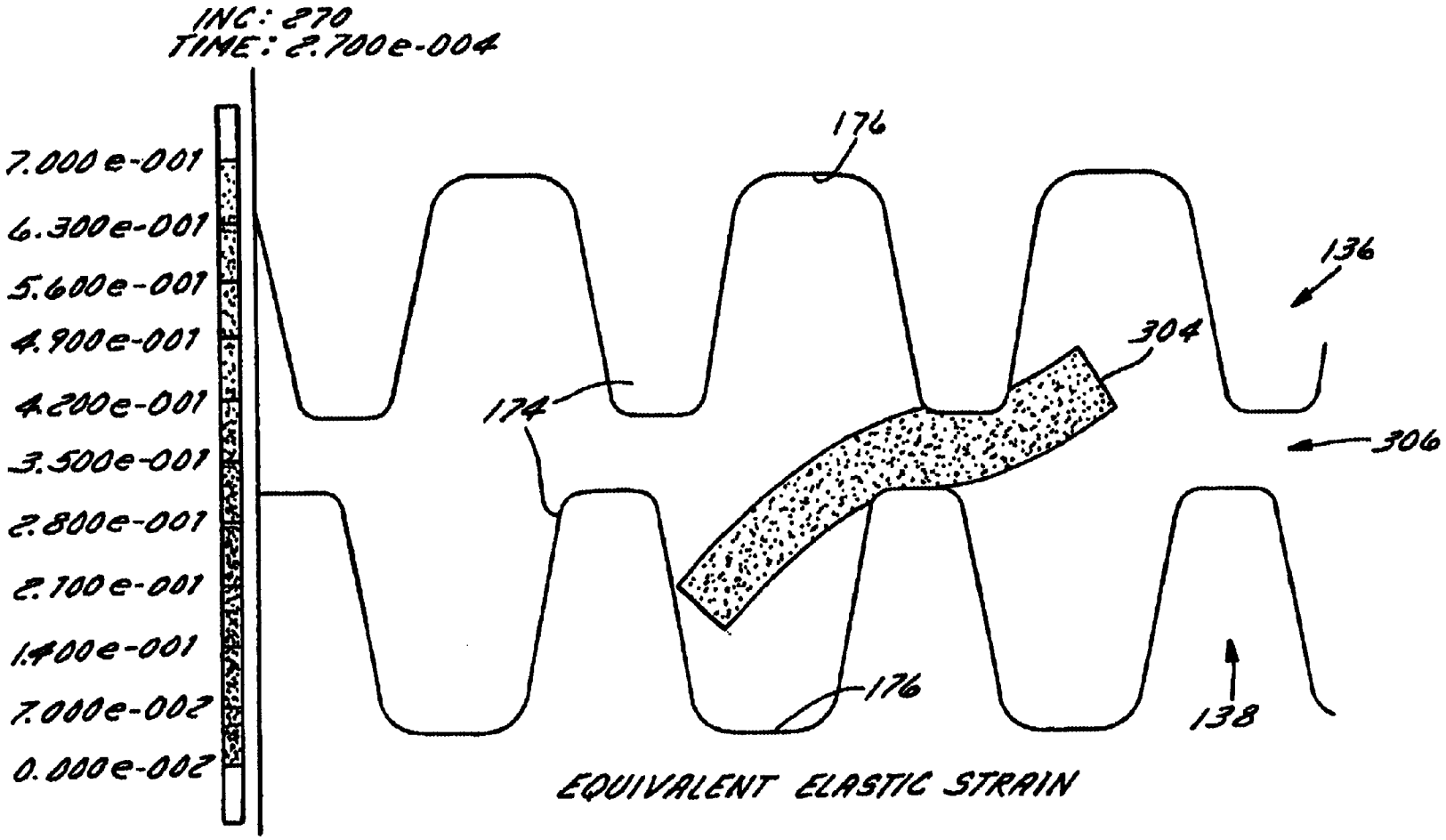
FIG. 23 depicts a piece of fiber being refined by a pair of refiner plates and the strain imparted on the fiber by the plates.

The key to understanding the process of mechanical pulping in refiners is through an analysis of how the power supplied to the refiner 32 is transferred to the wood and the water it contains. FIG. 23 illustrates how mechanical power is transferred to wood and water in the refining zone 304 through the geometry of a pair of refiner plates 136, 138. FIG. 23 also graphically depicts equivalent elastic strain that the refiner plates 136, 138 impart to fiber 304 being refined in the refining zone 306.

A precise macroscopic analysis would require a precise energy budget. This implies that a precise accounting of the total energy supplied to the refiner must be made in terms of the difference in the energy content of the wood, steam and water entering and leaving the refiner 32. This is not an easy task given that energy can be stored in various forms.

Despite these seemingly very difficult obstacles, a few simplifying, and not unreasonable, assumptions can make the application of the energy principle practically feasible. These assumptions have their basis in the pulping process, and therefore an explanation of the assumptions is provided below.

Broadly speaking, the energy stored in the wood and the water/steam is of three forms:

(a) Kinetic energy. Kinetic energy is the energy a system has by virtue of the bulk (macroscopic) motion of its constituents. During steady state refiner operation, throughput is constant (short term) and consequently the change in kinetic energy of the wood and water across the refiner is an unimportant contribution. Moreover, feed rates are such that the velocity of the wood and water are small enough that they store an insignificant amount of kinetic energy. The significant source of kinetic energy is that present in the steam that leaves the refiner. This kinetic energy however is generated through conversion of the internal and potential energy of the produced steam. Therefore, kinetic energy preferably can be neglected in an energy budget that accounts for the production of steam.

(b) Potential energy. Potential energy is the energy present in the system by virtue of its position relative to a force field. Potential energy comes in various forms. The least important form is gravitational potential energy, which can straightaway be neglected because elevation change in the entire process is negligible. Strain energy is the elastic energy stored in a body when it has been deformed under the action of applied forces. This energy is completely recovered when the applied forces are removed. A strong case can be made for neglecting the potential energy in the system because it has very non-linear behavior and, like metals, exhibits permanent deformation when compressed beyond a certain point.

Figure 24:
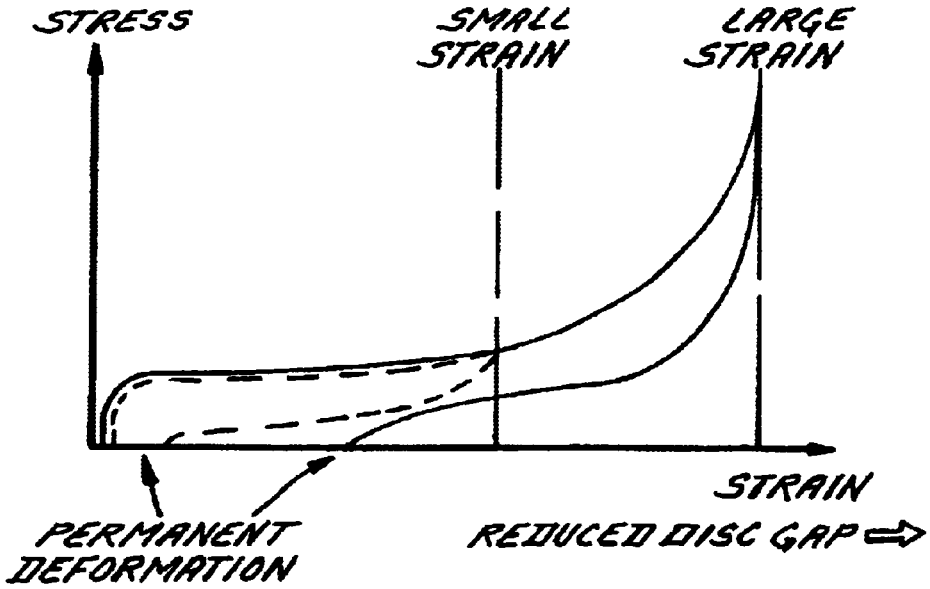
FIG. 24 is a load-deflection or stress-strain curve for wood being refined.

When wood is compressed, initial stress-strain behavior is linear. The energy stored during this period is strain energy and is recoverable. When the load is high enough, a form of yielding occurs and the stiffness of the wood decreases. FIG. 24 is a typical load-deflection (stress-strain) curve for wood and it shows that only a small portion of the energy is actually lost. FIG. 24 illustrates the following relationship: as the refining gap is reduced, both stress and strain increase. It also illustrates that hysteresis occurs.

Therefore, when wood is crushed it is fair to assume that only a small portion of the energy supplied can be recovered.

Since wood, like ductile metals, is relatively tough in compression, it can be concluded that only a small amount of the energy supplied to compress the wood will be stored as surface energy. On the basis of the above arguments, both the strain energy and surface energy preferably can be neglected.

Water too can have strain energy, but since it is in a freely flowing environment, rather than an enclosed environment, it is unlikely to contain much strain energy.

Thus, the potential energy of a system consisting of the wood chips and water can be neglected.

Internal energy is the energy associated with 'heat' and is the energy that a system has by virtue of its temperature. Internal energy is commonly called heat and is manifested in a temperature rise in the system.

In the pulping process, there are likely to be only small increases in kinetic and potential as explained above. Therefore, in accordance with the first law of thermodynamics, the work done by the refiner 32 must increase the internal energy of the system or be dissipated as heat. In a refiner 32 there is little scope for heat dissipation because of the tremendous rate at which energy is supplied to the refining zone 306. Actually, direct observation indicates that most of the "heat dissipation" occurs when steam generated during pulping leaves the refining zone 306.

Thus, the key conclusion that may be drawn from the argument presented above is that most of the work done by the refiner 32 is converted to internal energy of the wood-and-water system before it leaves the refining zone 306.

The internal energy comes from two main components of the work done by the refiner. These are (1) the work required for permanent deformation of the wood and (2) the work done to overcome friction in all its forms (wood against wood, viscous resistance offered by the water, refiner segments against wood and water etc). A smaller contribution is made by the inherent viscoelastic and viscoplastic nature of the wood itself.

Figure 25:
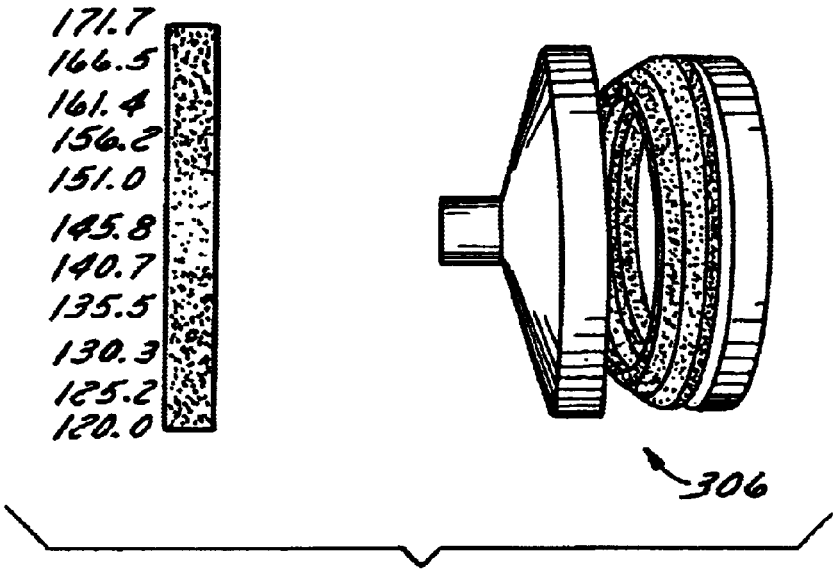
FIG. 25 illustrates a typical temperature profile in the refining zone of a single disc high consistency refiner.

Thus, the end result is an increase in the temperature of the system because of the increase in internal energy. FIG. 25 illustrates a typical temperature profile in the refining zone in a single disc high consistency refiner.

Typically, the temperature in high consistency refiners rises enough that the moisture in the wood is converted to steam, making the pulp drier than the incoming chips. The steam generated is confined to the cramped refining zone and therefore its pressure builds up, which leads to an associated rise in temperature.

The principle of conservation of energy, also called the first law of thermodynamics states:

$$Q+W=\Delta KE+\Delta PE+\Delta U \qquad \text{(Equation XII)}$$

This law applies to a closed system, i.e., a system with constant mass. Q is the heat transferred to the system, W is the work done on the system, KE is the kinetic energy, PE is the potential energy, U is the internal energy, and the A symbol represents change or increment.

Using the argument from the previous section, the first law can be approximated for the wood-water system in the refiner 32. The changes in kinetic and potential energy are small relative to the internal energy and the heat transferred to/from the system is small compared to the work done by the refiner. This gives $$W=\Delta U \quad \text{(Equation XIII)}$$

In a process or flow-based system, it is much more convenient to operate in terms of time rates of change of work, heat and energy. Thus, if the power supplied to the refiner 32 is P, then the work done by it in a time increment Δt is PΔt and the change in internal energy of the wood-water system will be $$P\Delta t = \Delta U \quad \text{(Equation XIV)}$$

$$P = \frac{\Delta U}{\Delta t}$$

As time approaches zero, a true rate equation is obtained:

$$P = \frac{dU}{dt} = \dot{U} \quad \text{(Equation XV)}$$

Technically, Equation XV applies to the pulping process, but it cannot be applied directly because the refining zone 306 is an open system, defined by a fixed volume in space with material crossing the boundaries of the volume. Such an open system is also called a control volume. In order to use it, two corrective terms need to be added to account for the influx and outflux of energy across the boundaries of the refining zone. The corrected equation is:

$$P+\dot{U}_{in}=\dot{U}+\dot{U}_{dot} \quad \text{(Equation XVI)}$$

The subscripts in and out refer to influx and efflux respectively. U now represents the internal energy within the refining zone 306. The equation above is applicable to any open system and this includes an open system of infinitesimal dimensions.

After putting the terms above in the energy equation and neglecting products of infinitesimals, it is reduced to the form:

$$2\pi r\overline{W}dr = 2\pi rLm_S dr + \dot{m}H_s dT + \dot{m}\frac{1-C}{C}H_l dT + 2\pi rm_s H_l T dr + \dot{m}H_l T d1 - \frac{C}{C} \quad \text{(Equation XVII)}$$

The last two terms in the equation above sum to zero because of conservation of mass. The remaining terms can be rearranged to give $$m_s = \frac{1}{L}\left(\overline{W} - \frac{\dot{m}}{2\pi r}\left[H_s + \frac{1-C}{C}H_l\right]\frac{dT}{dr}\right) \quad \text{(Equation XVIII)}$$

Thus, the application of mass and energy conservation to the open system containing moist wood yields two equations for the consistency and the steam production rate, respectively, in the refining zone 306. These equations are:

$$\frac{dC}{dr} = 2\pi r\frac{m_s}{\dot{m}}C^2 \quad \text{(Equations XIX and XX)}$$

$$m_s = \frac{1}{L}\left(\overline{W} - \frac{\dot{m}}{2\pi r}\left[H_s + \frac{1-C}{C}H_l\right]\frac{dT}{dr}\right)$$

Figure 26:
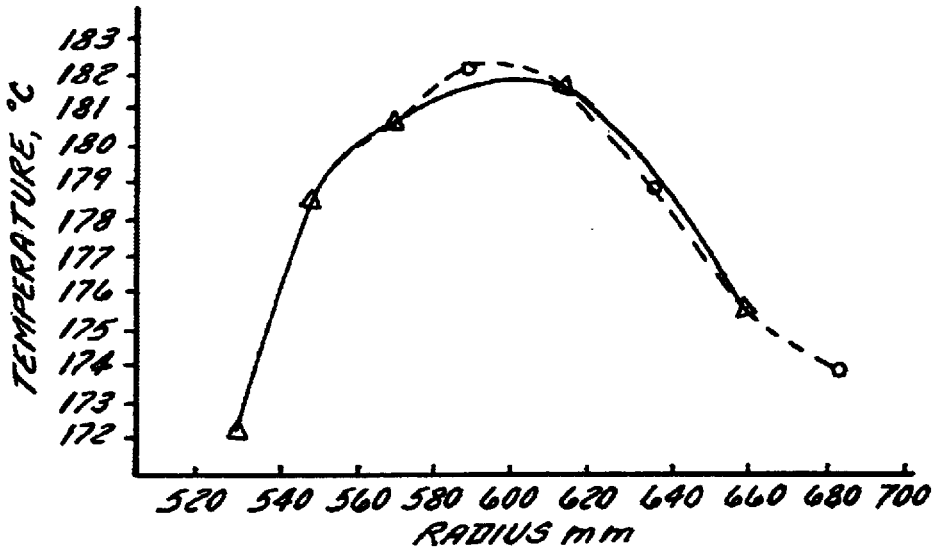
FIG. 26 is a plot of refining zone temperature as a function of radius.

The temperature and specific power can be obtained through direct measurement. FIG. 26 is a typical plot of the refining zone temperature as a function of radius. In the segment 173 shown in FIG. 7, sensors at different radial positions provide the required information.

Figure 27:
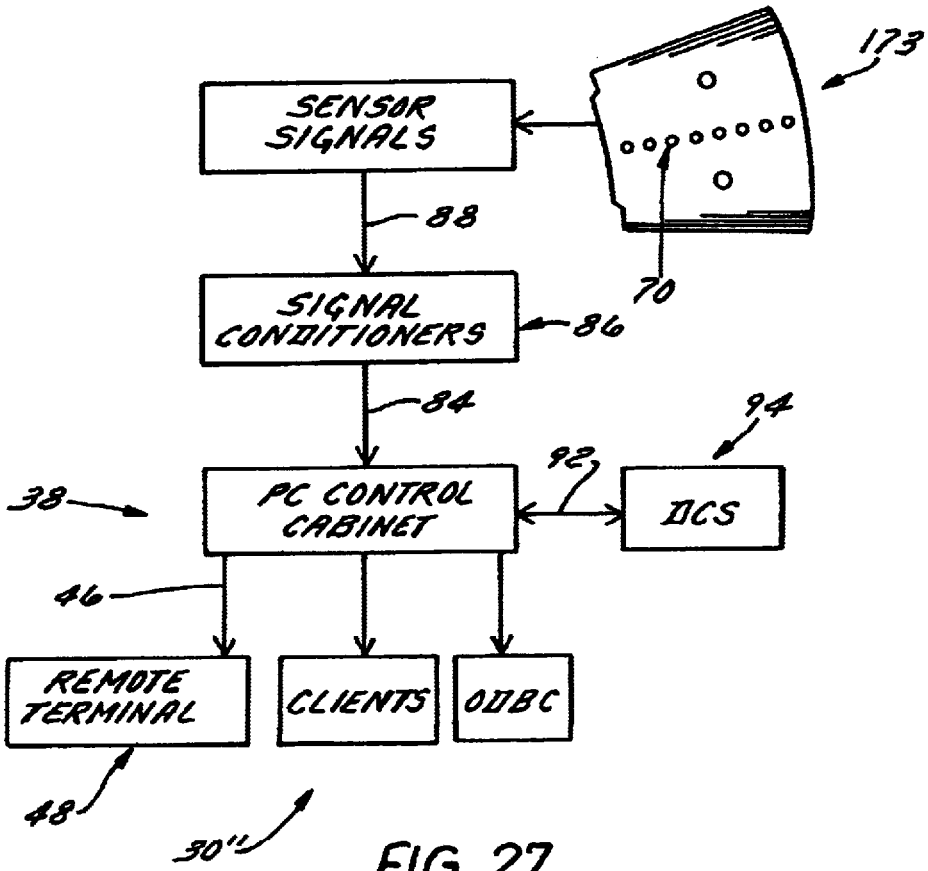
FIG. 27 is a schematic of a system for measuring consistency and for controlling refiner operation using the measured consistency.

Referring to FIG. 27, signals from the sensor segment 173 are fed into a PC computer, such as that depicted by reference numeral 38, for analysis and control. By attaching system 30" as a "transmitter," all interlocks and logic are kept in the DCS 94. Keeping the interlocks on both sides (system 30" and DCS 94) ensures a fail-safe communication between the two.

The system 30" used in determining consistency consists of four major components shown in FIG. 27. The system includes sensor segment 173, signal conditioners 86, a PC based control box 38, and a remote monitor/keyboard 48. The system 30" communicates with the mill DCS system 94 through analog and digital signals 92, just like other process transmitters.

The refiner plates are equipped with a sensor array 70, which sends the process conditions to the signal conditioners 86, located in a electrical box outside the refiner 32. Analog signals (4–20 mA) are then fed to the PC control box 38, where the signals are analyzed and a new control output 92 is computed. The control output 92 from the system 30" arrives at the DCS as a remote setpoint, commonly referred to as a cascade mode. A user interface can be provided through a remote terminal 48.

Figure 22:
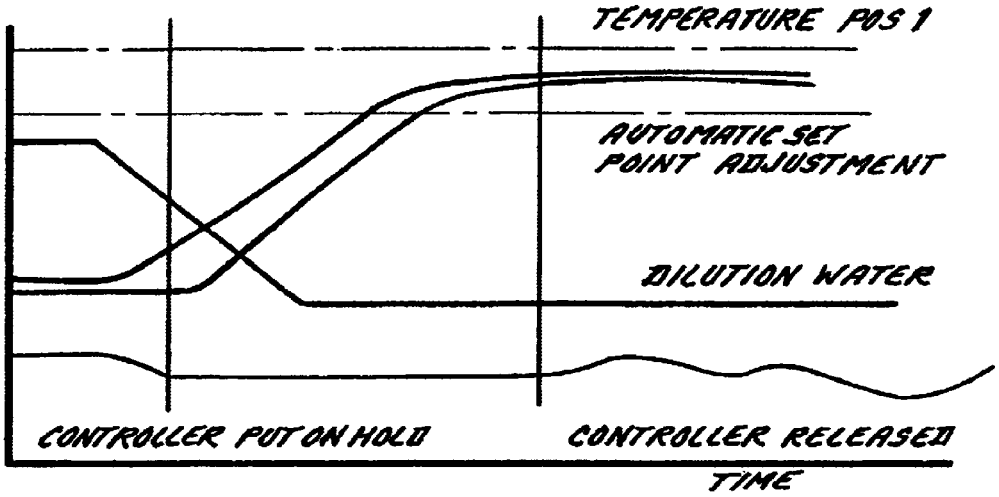
FIG. 22 is a graph illustrating a change in a refiner operating parameter putting a controller of the control method on hold and then releasing the controller when a process variable of the control method has stabilized.
Figure 28:
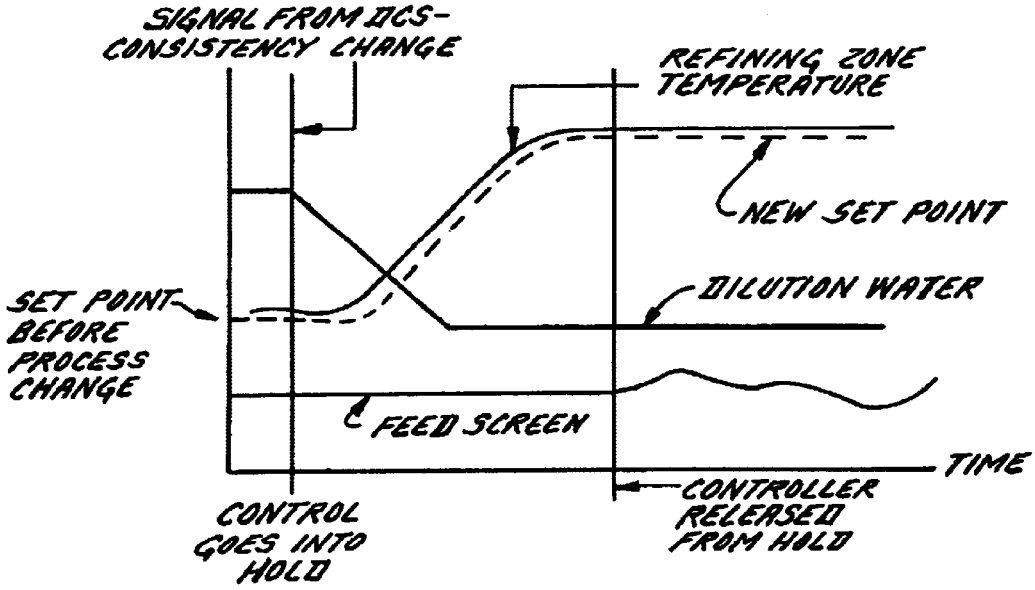
FIG. 28 is a graph illustrating operation of a controller that controls refiner operation based on measured consistency.

Referring to FIGS. 22 and 28, the operator retains total control of the refiner 32 through a unique "hold" protocol between the DCS 94 and the system 30".

If for example the operator would like to adjust the specific energy applied by reducing the amount of dilution water, the controller 274 of the system 30" is temporarily put on hold. The hold is kept until a new steady state process value has been reached, and then the controller is released with this process value as a new set point. As a result of the "hold" function, the operator and the controller of the system 30" will not compete for the desired set points. The operator decision overrides the controller of the system 30".

The control loops used preferably are conventional PID controllers that are easily customized to fit specific needs. Several individual refiners can be controlled independently using the same system 30".

Figure 29:
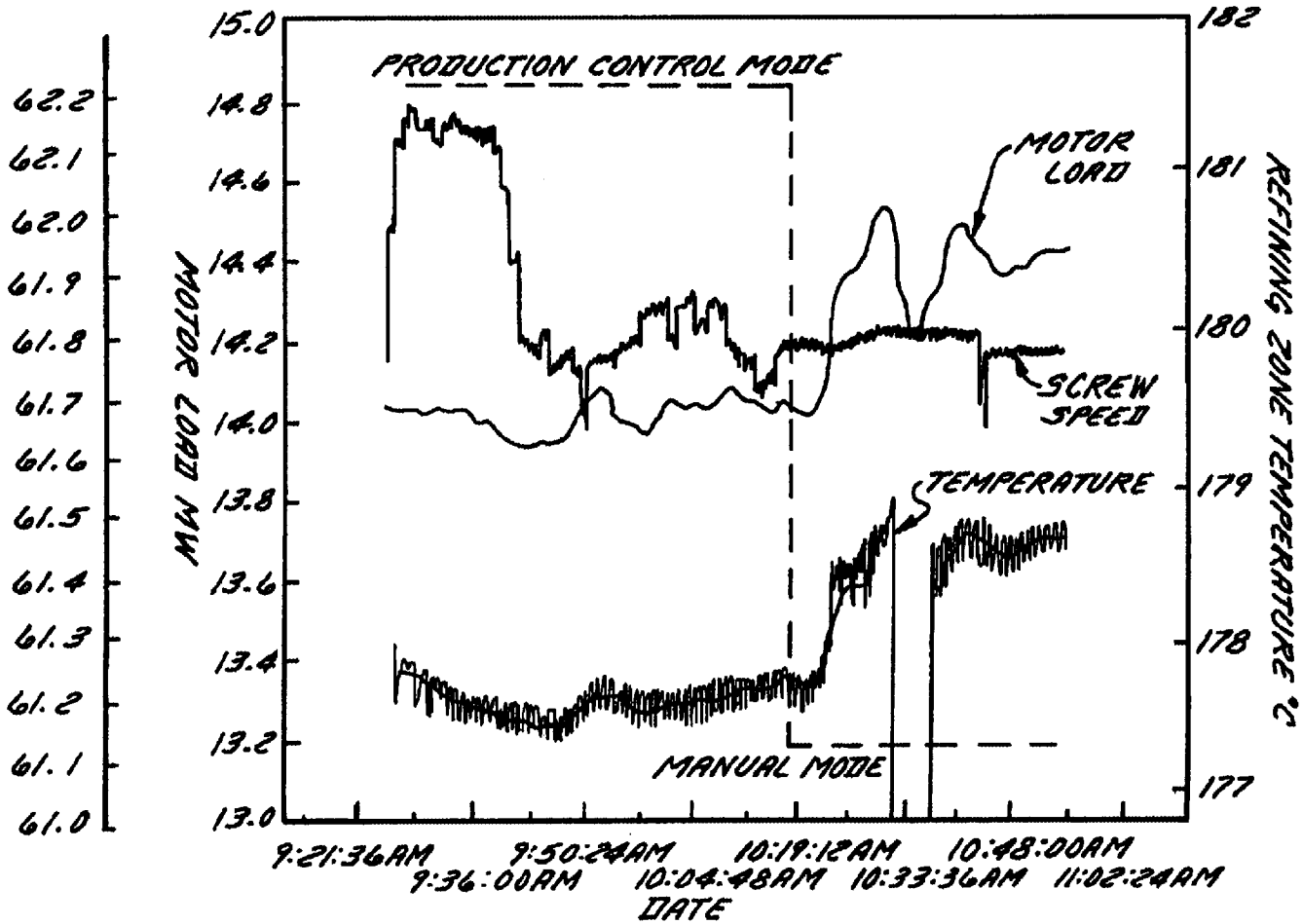
FIG. 29 is a graph depicting refiner performance with and without refiner control based on consistency.

FIG. 29 is a typical graph of the refiner control system 30" operating in production control by maintaining a constant refining zone temperature distribution. The difference between control mode and manual mode is shown in the example of FIG. 29 as a dashed line. In control mode, the motor load is stable between 13.9–14.1 MW over the period shown. For the same period, the refiner control system 30" varies the feed screw rate between 61.5% to 62.7%. The controller 274 needs to change the screw speed in order to maintain a set point of 178° C. Because refining zone temperature is constant, a constant motor load is maintained. Once the controller is switched to manual mode (constant feed screw speed), both motor load and refining zone temperature vary significantly.

Figure 30:
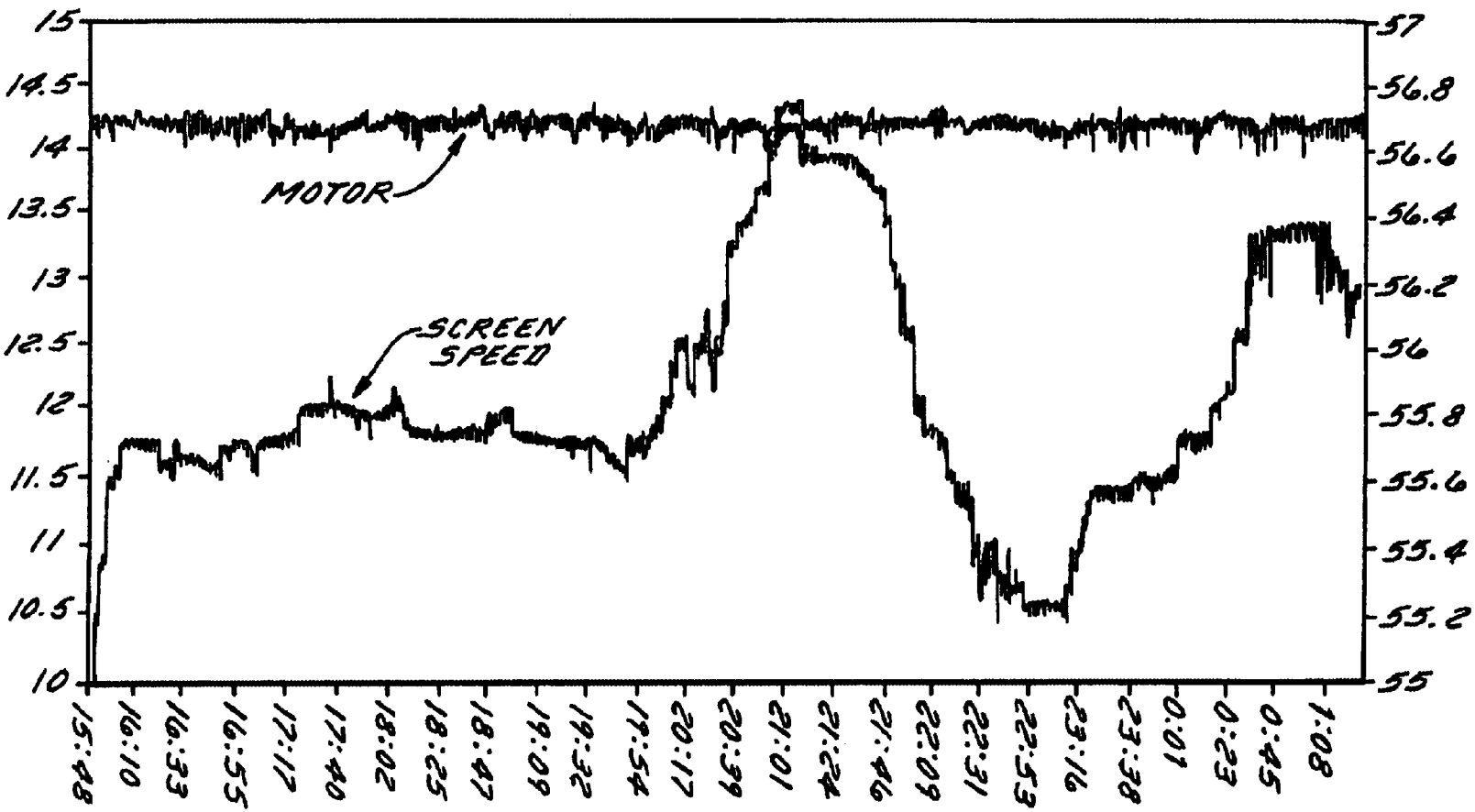
FIG. 30 illustrates operation of a refiner being controlled by a controller that controls refiner operation based on measured consistency.

The change in raw material can clearly be seen in FIG. 30 when operation is observed over a longer period.

Trials have also been conducted to investigate what impact the reduced variation in refiner operation has on the resulting pulp quality. Table 1 below lists the standard deviation of CSF results in a study where two parallel Andritz TWIN 60 inch refiners are compared. Approximately 70 composite primary blow-line samples were collected over a 48 hour period.

TABLE 1

| | Line A | Line B | A–B Difference |
|---|---|---|---|
| Line B in manual | 11.7 | 11.1 | 5% |
| Line B in control | 28.7 | 3.7 | 87% |

The standard deviation of the blow line freeness was virtually identical when both primary refiners were operating in manual. Repeating the trial with line B in control however, reduced the variation by 87%.

A refiner control system 30", which is based on fundamental physical laws, was described above. The consistency and the steam generated in a refiner 32 can be calculated by applying conservation of mass and energy.

The application of these principles is based on the argument that a majority of the power input to the refiner 32 appears in the form of heat that raises the temperature in the refining zone and produces steam. As input, the method preferably requires an array of sensors 70 within the refining zone 306.

By controlling the refining zone temperature the operating stability of the TMP system is greatly improved. As a consequence, the resulting freeness variation is significantly reduced.

Mathematical theory and equations behind the method are disclosed below:

The model is based on the following two equations for conservation of mass and energy, respectively:

$$\frac{dC}{dr} = 2\pi r \frac{m_s}{\dot{m}} C^2 \qquad \text{(Equation XXI)}$$

$$m_s = \frac{1}{L}\left(\overline{W} - \frac{\dot{m}}{2\pi r}\left[H_s + \frac{1-C}{C}H_l\right]\frac{dT}{dr}\right) \qquad \text{(Equation XXII)}$$

The physical quantities that correspond to the variables in the above equations are listed in Table 2 below:

TABLE 2

| Symbol | Description | Units |
|---|---|---|
| C | Consistency | Dimensionless |
| $m_s$ | Specific steam generation rate | kg/m$^2$-sec |
| $\dot{m}$ | Dry wood throughput | kg/sec |
| R | Radial position | M |
| L | Latent heat of steam | KJ/kg |
| $\overline{W}$ | Specific power | KW/m$^2$ |
| $H_s$ | Wood heat capacity | KJ/kg-° C. |
| $H_l$ | Water heat capacity | KJ/kg-° C. |
| T | Temperature | ° C. |

One or more of the following inputs preferably are used in determining consistency: the refiner main motor power, the force exerted on the refiner disks urging them together (or hydraulic pressure or force), the dilution motor power of the refiner for each dilution pump, the refiner case pressure, the refiner inlet pressure, the chip washing water temperature, the dilution water temperature, as well as the gap between refiner disks.

The consistency, C, is determined as a function of radial position in the refining zone 306. The temperature, T, is a temperature of stock preferably in the refining zone 306 or upstream of the refining zone 306. Where the temperature, T, is measured upstream of the refining zone 306, it preferably is measured slightly upstream of the refining zone 306, such as immediately before the location where stock enters the refining zone 306. If desired, the temperature, T, can be measured at the refiner inlet 114 where stock enters the refiner 32. Where the temperature, T, is a temperature in the refining zone 306, it preferably is measured at or adjacent where stock enters the refining zone 306. The temperature, T, can be measured anywhere in the refining zone 306. Where a refiner 32 has more than one opposed pair of refiner disks, the temperature, T, preferably is taken upstream of the radially innermost pair of refiner disks or in its refining zone.

Where a sensor refiner disk or disk segment 173 is used, temperature, T, can be a temperature measurement from a single sensor, such as sensor 180, 186, or 194, or an average temperature determined from temperature measurements taken from a group of sensors, such as sensors 194, 192 and 190 (or all of the sensors). Where it is desired to measure temperature, T, in the refining zone 306 adjacent where stock enters, sensor 190, 192 or 194 can be used. Preferably, the temperature measurement from sensor 194 is used in such a case.

If desired, the temperature, T, can be determined using a combination of a temperature of stock entering the refiner 32 and a temperature of stock in the refining zone 306. One such example is an average temperature of the average of the temperature of stock entering the refiner 32 and a temperature of stock in the refining zone 306.

The latent heat of steam, L, is obtained from steam tables known in the art. The latent heat, L, is obtained for the temperature, T, that is measured. The specific power, $\overline{W}$, is determined by dividing the power input into the refiner 32, typically in megawatts, by the refiner disk surface area, in square meters.

The specific steam generation rate, $m_s$, is determined using an energy balance that assumes that all energy inputted into the refiner is converted to heat. Thus, it is assumed that the specific power, $\overline{W}$, of the refiner is converted into heat and known steam tables (not shown) are used to determine the specific steam generation rate using this assumption. Where implemented as part of an algorithm that is executed by a processor, one or more steam tables are utilized as lookup tables.

The wood heat capacity, $H_s$, is taken from a known wood heat capacity table based on the temperature of the chips measured before the stock enters the refiner 32. The water heat capacity, $H_1$, is also taken from a known table of water heat capacities and is based on the temperature of the water in the stock measured before the stock enters the refiner 32.

If the temperature, T, and the specific power, $\overline{W}$, are known as functions of radial position, the two equations above can be combined to produce a non-linear ordinary differential equation (ODE) of first order for the consistency, C. This equation is:

This non-linear 1$^{st}$ order ODE can be converted into a linear 1$^{st}$ order ODE by noting that:

$$-\frac{1}{C^2}\frac{dC}{dr} = \frac{d}{dr}\left(\frac{1}{C}\right) = \frac{d}{dr}\left(\frac{1-C}{C}\right) \qquad \text{(Equation XXIII)}$$

Accordingly, by defining a new variable Z as (1−C)/C, the following linear order 1$^{st}$ order ODE results:

$$\frac{dZ}{dr} = \frac{H_l}{L}\frac{dT}{dr}Z + \frac{1}{L}\left(H_s\frac{dT}{dr} - \frac{2\pi r}{\dot{m}}\overline{W}\right) \qquad \text{(Equation XXIV)}$$

This equation is of the general form:

$$\frac{dZ}{dr} = f(r)Z + g(r) \quad \text{(Equation XXV)}$$

From ODE theory, a general solution to the above equation is:

$$Z(r) = Ae^{\int f(r)dr} + e^{\int f(r)dr}\int g(r)e^{-\int f(r)dr}dr \quad \text{(Equation XXVI)}$$

The solution for this specific problem is easily obtained upon substitution of the appropriate functions f(r) and g(r) into the equation above. A is an arbitrary constant that is determined from the initial condition, i.e., the value of consistency (and therefore Z) at the inlet to the refiner. The final solution for Z is given below $$Z(r) = Z(r_i)\left(\frac{L(r)}{L(r_i)}\right)^{\frac{H_l}{\beta}} + \frac{H_s}{H_l}\left[\left(\frac{L(r)}{L(r_i)}\right)^{\frac{H_l}{\beta}} - 1\right] - \frac{2\pi}{\dot{m}}L(r)^{\frac{H_l}{\beta}}\int r\overline{W}(r)L(r)^{\left(-\frac{H_l}{\beta}-1\right)}dr \quad \text{(Equation XXVII)}$$

This solution is based on the assumption that the latent heat of steam (L(r)) is a linear function of temperature of the form:

$$L(r)=\alpha+\beta T(r) \quad \text{(Equation XXVIII)}$$

The inlet radius is $r_i$. Since the temperature and the specific power are obtained at discrete points, the quadrature (last term in the equation for Z) is a function of the fitting or interpolation procedure used to obtain the measured quantities as continuous functions of radial position. Once the fitting or interpolation functions (a and P) are known, the integration can be carried out numerically.

Finally, the consistency can be obtained from Z(r) as:

$$C = \frac{1}{1+Z} \quad \text{(Equation XXIX)}$$

This method preferably is implemented in software or firmware to compute the consistency. A piecewise linear interpolation function preferably is used for the temperature and specific power functions, which provides the advantage that the quadrature in the functional representation of Z(r) can be exactly evaluated. Doing so, assumes that both the temperature and specific power data is available at the same radial locations.

Such a software or firmware implemented algorithm preferably can compute the consistency as a function of radial position. Only one measurement of consistency, C, is needed by the controller 274 shown in FIG. 20 or 21. In one preferred implementation of this method, the consistency, C, determined is the consistency at the inlet of the refining zone or adjacent a radial inward location of the refining zone.

FIGS. 22 and 28 graphically illustrate a controller 274 being put on hold when an operating parameter of the refiner 32 is changed. The controller 274 is released after the operating parameter has been changed and when its process variable has stabilized. For example, when the flow rate of the dilution water is changed, such as when an operator changes it or when a DCS 94 changes it in response to a change in motor load, the controller 274 is put on hold at the time designated by line 300 (FIG. 21). A link 92 between the DCS 94 and the control computer 38 can communicate when such a refiner operating parameter has been changed and thereby cause the controller 274 to be put on hold.

After the operating parameter change has been made, the refiner 32 begins to stabilize. For example, where refiner temperature is the process variable, the temperature will change and then stabilize in the manner shown in FIG. 22. Where consistency is the process variable, it too will stabilize. When the process variable has sufficiently stabilized, its value when the stabilization determination is made is adopted as the new setpoint and the controller 274 is released, such as at the time indicated by line 302. When released, the controller resumes operation.

The control processor 34 preferably is configured with the control method of this invention or a preferred implementation of the control method. The control method preferably is implemented in software on board the control processor 34. Preferably, the control method is implemented in the form of a controller that preferably is a PI controller or a PID controller.

It is also to be understood that, although the foregoing description and drawings describe and illustrate in detail one or more preferred embodiments of the present invention, to those skilled in the art to which the present invention relates, the present disclosure will suggest many modifications and constructions as well as widely differing embodiments and applications without thereby departing from the spirit and scope of the invention. The present invention, therefore, is intended not to be limited by the foregoing description.

What is claimed is:

1. A method of determining a consistency of stock comprising:

(a) providing a refiner having a pair of spaced apart and opposed refiner plates that define a refining zone therebetween, a sensor disposed in the refiner that senses a parameter of the refining zone, a processor, and a link between the sensor and the processor;

(b) sensing a parameter inside the refiner;

(c) communicating the sensed parameter to the processor; and (d) determining consistency of stock flowing through the refiner in real time during refiner operation using the sensed parameter and an initial consistency value.

2. The method according to claim 1 wherein the sensor comprises a temperature sensor, there are a plurality of temperature sensors, and the sensed parameter comprises a temperature inside the refining zone.

3. The method according to claim 1 wherein the processor comprises a DCS.

4. The method according to claim 1 further comprising a DCS and a link between the processor and the DCS.

5. The method according to claim 2 wherein each temperature sensor is disposed in one of the refiner disks and the sensed parameter comprises a temperature of stock in the refining zone.

6. The method according to claim 1 wherein the sensor comprises a pressure sensor, there are a plurality of pressure sensors, and the sensed parameter comprises a pressure inside the refining zone.

7. The method according to claim 6 wherein each pressure sensor is disposed in one of the refiner disks and the sensed parameter comprises a pressure of stock in the refining zone.

8. The method according to claim 1 wherein the sensed parameter comprises a temperature and a pressure.

9. The method according to claim 1 wherein the link between sensor and the processor further comprises a signal conditioner, and further comprising a DCS and a second link between the processor and the DCS.

10. The method according to claim 1 wherein the sensed parameter is communicated to the processor via the link between the sensor and the processor.

11. The method according to claim 10 further comprising a signal conditioner disposed between the sensor and the processor that receives a signal from the sensor and outputs a conditioned signal to the processor.

12. The method according to claim 1 wherein the refiner has a motor that provides power to the refiner, the sensed parameter comprises a temperature or pressure in the refining zone, and consistency is determined using the sensed parameter, and a distribution of motor load in the refining zone.

13. The method according to claim 1 wherein the sensed parameter comprises a temperature or pressure in the refining zone, and consistency is determined using the sensed temperature or pressure, and specific power.

14. The method according to claim 1 wherein the sensed parameter comprises a temperature or pressure in the refining zone, and consistency is determined using the sensed temperature or pressure, specific steam generation rate, dry wood throughput, latent heat of steam, specific power, wood heat capacity, and water heat capacity.

15. The method according to claim 1 wherein the sensed parameter comprises a temperature or pressure in the refining zone, and consistency is determined as a function of radial position in the refining zone using the sensed parameter, and specific power.

16. The method according to claim 1 wherein the refiner has a refining zone therein, the sensed parameter comprises a stock temperature or stock pressure in the refining zone, and consistency is determined as a function of radial position in the refining zone using the sensed temperature or pressure, specific steam generation rate, dry wood throughput, latent heat of steam, specific power, wood heat capacity, and water heat capacity.

17. The method according to claim 1 wherein the sensed parameter comprises a temperature or pressure in the refining zone, and consistency is based on the following equation:

$$C = \frac{1}{1+Z}.$$

18. The method according to claim 17 wherein the variable Z is determined using the following equation:

$$Z(r) = Z(r_i)\left(\frac{L(r)}{L(r_i)}\right)^{\frac{H_l}{\beta}} + \frac{H_s}{H_l}\left[\left(\frac{L(r)}{L(r_i)}\right)^{\frac{H_l}{\beta}} - 1\right] - \frac{2\pi}{\dot{m}}(L(r))^{\frac{H_l}{\beta}}\int r\overline{W}(r)(L(r))^{\left(-\frac{H_l}{\beta}-1\right)}dr$$

19. The method according to claim 18 wherein the variable L(r) is a value for the latent heat of steam based on the sensed temperature or pressure and is determined using the following equation:

$$L(r)=\alpha+\beta T(r).$$

20. The method according to claim 1 further comprising a controller and the further step of the controller using the determined consistency to control some aspect of operation of the refiner.

21. The method according to claim 20 wherein the controller adjusts the mass flow rate of fiber into the refiner using the determined consistency.

22. The method according to claim 20 wherein the controller adjusts the flow rate of dilution water using the determined consistency.

23. A method of determining a consistency of stock comprising:

(a) providing a refiner with a plurality of spaced apart and opposed refiner plates that define a refining zone therebetween, a sensor disposed in one of the plates that senses a parameter in the refining zone, and a processor that communicates with the sensor;

(b) sensing a parameter inside the refining zone;

(c) communicating the sensed parameter to the processor; and (d) determining a consistency of stock using the sensed parameter, a distribution of motor load in the refining zone or specific power, and initial consistency.

24. A method of determining a consistency of stock comprising:

(a) providing a refiner with a plurality of spaced apart and opposed refiner plates that define a refining zone therebetween, a sensor disposed in one of the plates that senses a parameter in the refining zone, and a processor that is in communication with the sensor;

(b) sensing a parameter inside the refining zone;

(c) outputting a signal;

(d) processing the signal to obtain a temperature or pressure in the refining zone; and (e) determining a consistency of stock using the temperature or pressure obtained, specific steam generation rate, dry wood throughout, latent heat of steam, wood heat capacity and water heat capacity.

25. A method of determining a consistency of stock in a refiner comprising:

(a) providing a refiner with a plurality of spaced apart and opposed refiner plates that define a refining zone therebetween, a sensor disposed in one of the plates that provides a parameter in the refining zone, and a processor that is in communication with the sensor;

(b) obtaining a parameter inside the refining zone; and (c) determining a consistency of stock in the refiner as a function of position or location in the refining zone using the obtained parameter, and a distribution of motor load in the refining zone or specific power.

26. A method of determining a consistency of stock in a refiner comprising:

(a) providing a refiner with a plurality of spaced apart and opposed refiner plates that define a refining zone therebetween, a sensor disposed in the refiner that provides a temperature or pressure inside the refiner, and a processor that is in communication with the sensor;

(b) obtaining a temperature or pressure inside the refiner; and (c) determining a consistency of stock in the refiner during refiner operation using the obtained temperature or pressure, a refiner load or a refiner power, a latent heat of steam, a wood heat capacity, and a water heat capacity.

27. A method of determining a consistency of stock in a refiner comprising:

(a) providing a refiner with a plurality of spaced apart and opposed refiner plates that define a refining zone therebetween, a sensor disposed in the refiner that provides a temperature or pressure inside the refiner, and a processor that is in communication with the sensor;

(b) obtaining a temperature or pressure inside the refiner;

(c) determining a latent heat of steam based on the obtained temperature or pressure using the following equation:

$$L(r)=\alpha+\beta T(r)$$

(d) determining a value Z(r) using the latent heat of steam calculated in step (c) using the following equation:

$$Z(r) = Z(r_i)\left(\frac{L(r)}{L(r_i)}\right)^{\frac{H_l}{\beta}} + \frac{H_s}{H_l}\left[\left(\frac{L(r)}{L(r_i)}\right)^{\frac{H_l}{\beta}} - 1\right] - \frac{2\pi}{\dot{m}}(L(r))^{\frac{H_l}{\beta}}\int r\overline{W}(r)(L(r))^{\left(-\frac{H_l}{\beta}-1\right)}dr$$

(e) determining a value C(r) using the value of Z(r) calculated in step (d) using the following equation:

$$C = \frac{1}{1+Z}.$$

28. A method of determining a consistency of stock in a refiner comprising:

(a) providing a refiner with a plurality of spaced apart and opposed refiner plates that define a refining zone therebetween, a sensor disposed in the refiner that provides a temperature or pressure inside the refiner, and a processor that is in communication with the sensor;

(b) obtaining a temperature or pressure inside the refiner; and (c) determining a consistency of stock in the refiner in real time during refiner operation using the obtained temperature or pressure, a specific steam generation rate, a dry wood throughput, a latent heat of steam, a wood heat capacity, and a water heat capacity.

29. A method of determining a consistency of stock in a refiner comprising:

(a) providing a refiner that has a plurality of spaced apart and opposed refiner plates that define a refining zone therebetween, a motor that rotates one of the plates and which has a load during rotating the one of the refiner plates, a sensor disposed in one of the refiner plates that is used to obtain a temperature or pressure of stock inside the refining zone, a processor, and a link between the sensor and the processor;

(b) obtaining a temperature or pressure of stock inside the refining zone;

(c) determining a distribution of motor load in the refining zone or refiner specific power; and (d) determining a consistency of stock in the refining zone using the sensed temperature or pressure obtained in step (b), the distribution of motor load in the refining zone or refiner specific power obtained in step (c), and an initial estimated value of consistency.

30. A system for determining a consistency of a stock in a refiner, the system comprising:

(A) a plurality of refiner discs defining a refining zone;

(B) a sensor carried by the refiner that detects a process condition related to a physical property of the stock from which a signal can be obtained therefrom (C) a signal conditioner that receives and conditions the signal; and (D) a processor that receives the conditioned signal and that determines consistency of stock being refined during refiner operation using the conditioned signal, and at least a plurality of a refiner main motor power, a force exerted on the refiner discs urging them together, a dilution motor power, a refiner case pressure, a refiner inlet pressure, a chip washing water temperature, a dilution water temperature, and an amount of a gap between the refiner discs.

31. The system of claim 30 further comprising a controller that compares the determined consistency to a consistency setpoint and provides an output in response thereto that is used to control some aspect of operation of the refiner.

32. The system of claim 31 wherein the output of the controller is used in controlling some aspect of refiner operation to cause the determined consistency to converge with or toward the consistency setpoint.

33. The system of claim 30 further comprising an array of sensors disposed in the refiner, wherein each sensor detects a process condition related to the consistency of the stock or used in determining the consistency of the stock.

34. The system of claim 33, wherein the process condition detected is a temperature of the stock, wherein the processor averages the temperatures detected by the array of sensors, and wherein the processor determines the consistency of the stock using the average of the temperatures.

35. The system of claim 33, wherein the process condition detected is a temperature of stock entering the refiner and a temperature of stock in the refining zone, wherein the processor averages the temperatures detected by the array of sensors, and wherein the processor determines the consistency of the stock using the average of the temperatures.

36. The system of claim 30 further comprising a controller that is used to regulate some aspect of operation of the refiner in real time during refiner operation using the determined consistency.

37. The system of claim 30 wherein the sensor is located upstream of the refining zone.

38. The system of claim 30 wherein the conditioned signal from the sensor is used to detect or obtain a temperature of the stock in the refining zone.

39. The system of claim 30 further comprising a pump that introduces dilution water into the disc refiner at a flow rate that can be varied, wherein the processor provides a control output that alters a flow rate of a dilution water entering the disc refiner in response to the consistency determined.

40. The system of claim 30 wherein the processor provides a control output that alters a volumetric flow rate of the stock entering the disc refiner in response to the consistency determined.

41. The system of claim 30 further comprising a feed screw that has a rate of rotation that can be varied to change the mass flow rate of fiber entering the refiner and wherein the processor provides a control output that alters the rate of rotation of the feed screw in response to the consistency determined.

42. The system of claim 30 wherein the processor comprises a DCS.

43. The system of claim 30 further comprising a DCS that communicates with the processor.

44. A system for determining a consistency of a stock in a refiner, the system comprising:

(A) a plurality of refiner plates defining a refining zone in which the stock is refined;

(B) a sensor disposed in one of the refiner plates from which a temperature or pressure in the refining zone is determined; and (C) a processor that determines consistency of the stock flowing through the refiner using the determined temperature or pressure, refiner main motor power, force exerted on the refiner discs urging them together, refiner case pressure, and refiner inlet pressure.

45. A system for determining stock consistency comprising:

(A) a plurality of refiners that each refine a fibrous stock slurry;

(B) each refiner having a plurality of refiner plates defining a refining zone in which the stock is refined;

(C) a plurality of sensors disposed in one of the refiner plates of each refiner from which at least one temperature or pressure in the refining zone of the corresponding refiner is determined; and (D) a processor that determines consistency of the stock in each refiner in real time using at least one of the determined temperatures or pressures for the corresponding refiner.

46. A system for determining stock consistency comprising:

(A) a plurality of rotary disk refiners;

(B) each refiner having a plurality of annular and opposed refiner plates defining a refining zone in which stock is refined;

(C) an array of sensors disposed in one of the refiner plates of each refiner that output signals relating to a characteristic of the stock in the refiner;

(D) a signal conditioner that receives the output signals from each array of sensors and outputs conditioned signals;

(E) a processor that uses the conditioned signals to determine consistency of the stock in each refiner; and (F) a DCS that communicates data to the processor for the corresponding refiner that is used in determining the consistency of the stock of the corresponding refiner.

47. The method according to claim 23 further comprising a DCS that is linked to the processor that is configured to provide the processor in real time during refiner operation in step (d) at least one of the (i) distribution of motor load in the refining zone and (ii) specific power.

48. The method according to claim 23 further comprising a controller that is linked to the processor that is configured to affect some aspect of refiner operation using the consistency determined in step (d) and comprising the further step of using the consistency determined in step (d) to affect some aspect of refiner operation.

49. The method according to claim 48 wherein the controller is configured to affect refiner operation to keep the determined consistency at or within a predetermined range of a consistency setpoint or threshold.

50. The method according to claim 24 wherein the processor comprises a controller that is configured to affect some aspect of refiner operation using the consistency determined in step (e) and comprising the further step of using the consistency determined in step (e) to affect some aspect of refiner operation.

51. The method according to claim 50 wherein the processor is configured to affect refiner operation in a manner that keeps the determined consistency at or within a predetermined range of a consistency setpoint or threshold.

52. The method according to claim 25 wherein the processor comprises a controller that is configured to affect some aspect of refiner operation using the consistency determined in step (c) and comprising the further step of using the consistency determined in step (c) to affect some aspect of refiner operation.

53. The method according to claim 52 wherein the processor is configured to affect refiner operation in a manner that keeps the determined consistency at or within a predetermined range of a consistency setpoint or threshold.

54. The method according to claim 28 further comprising a controller that is linked to the processor that is configured to affect some aspect of refiner operation using the consistency determined in step (c) and comprising the further step of using the consistency determined in step (c) to affect some aspect of refiner operation.

55. The method according to claim 31 further comprising a controller that is linked to the processor that is configured to affect some aspect of refiner operation using the consistency determined in step (c) and comprising the further step of using the consistency determined in step (c) to affect some aspect of refiner operation.

56. The system according to claim 46 wherein the array of sensors comprises at least three radially spaced apart temperature sensor that each provide a signal from which a temperature of stock in the refining zone can be obtained and wherein there is a single signal conditioner that receives sensor signals from each sensor array of each refiner.

57. The system according to claim 46 wherein the processor comprises a computer, the DCS is linked by wiring to the computer, the DCS provides data related to refiner power or refiner load to the computer, and the computer is configured to use the data relating to refiner power or refiner load in determining stock consistency.

58. A system for determining stock consistency comprising:

a plurality of rotary disk refiners that each comprise a plurality of refiner plates defining a refining zone therebetween in which stock is refined, a temperature or pressure sensor disposed in a refining surface one of the refiner plates; and a plurality of pairs of sensors from which refiner motor power, refiner disk force, and refiner disk gap can be obtained or determined;

a processor that obtains or determines data including (a) a temperature or pressure of stock in the refining zone, (b) refiner motor power, (c) refiner disk force, and (d) refiner disk gap and uses the temperature or pressure, the refiner motor power, the refiner disk force, and the refiner disk gap in determining stock consistency.

59. The system according to claim 58 further comprising a DCS that is linked to the processor that is configured to provide the processor with at least some data that is used in determining stock consistency.

60. The system according to claim 58 wherein the processor comprises a DCS that is configured with software used in determining stock consistency.

61. The system according to claim 58 wherein the processor is configured to determine stock consistency by:

obtaining a latent heat of steam, L(r), based on the obtained temperature or pressure with the following equation:

$$L(r)=\beta+T(r)$$

obtaining a value, Z(r), using the latent heat of steam, L(r), with the following equation:

$$Z(r) = Z(r_i)\left(\frac{L(r)}{L(r_i)}\right)^{\frac{H_l}{\beta}} + \frac{H_s}{H_l}\left[\left(\frac{L(r)}{L(r_i)}\right)^{\frac{H_l}{\beta}} - 1\right] - \frac{2\pi}{\dot{m}}(L(r))^{\frac{H_l}{\beta}}\int r\overline{W}(r)(L(r))^{\left(-\frac{H_l}{\beta}-1\right)}dr; \text{ and}$$

obtaining a value of consistency as a function of radial position within the refining zone, C(r), using the value of Z(r) using the following equation set forth below:

$$C = \frac{1}{1+Z}.$$

62. A system for determining stock consistency comprising:

a plurality of rotary disk refiners that each comprise a plurality of refiner plates defining a refining zone therebetween in which stock is refined, a temperature or pressure sensor disposed in a refining surface one of the refiner plates; and a plurality of pairs of sensors from which refiner motor power, refiner disk force, and refiner disk gap can be obtained or determined;

a processor;

a DCS;

wherein one of the processor and the DCS is configured to obtain or determine for each refiner a plurality of (a) a temperature or pressure of stock in the refining zone, (b) refiner motor power, (c) refiner disk force, and (d) refiner disk gap;

wherein the other one of the processor and the DCS is configured to obtain or determine for each refiner a remainder of (a) a temperature or pressure of stock in the refining zone, (b) refiner motor power, (c) refiner disk force, and (d) refiner disk gap; and wherein one of the processor and the DCS is configured to use the temperature or pressure, the refiner motor power, the refiner disk force, and the refiner disk gap in determining stock consistency for each corresponding refiner.

63. A system for determining and using stock consistency comprising:

a plurality of rotary disk refiners that each comprise a plurality of annular refiner plates defining a refining zone therebetween in which stock is refined, and a temperature or pressure sensor carried by one of the refiner plates that provides an output from which a temperature or pressure of stock in the refining zone is obtainable;

a processor configured to obtain a temperature or pressure of stock in the refining zone of each refiner and determine a consistency of stock using the obtained temperature or pressure; and a controller configured to use the determined stock consistency of each refiner to affect some aspect of operation of the corresponding refiner.

64. The system according to claim 63 wherein the processor comprises the controller.

65. The system according to claim 63 further comprising a DCS that is configured to provide the processor with data used in determining the determined stock consistency.

66. A system for determining and using stock consistency comprising:

a plurality of rotary disk refiners that each comprise a plurality of annular refiner plates defining a refining zone therebetween in which stock is refined, and a temperature or pressure sensor carried by one of the refiner plates that provides an output from which a temperature or pressure of stock in the refining zone is obtainable;

a processor configured to obtain a temperature or pressure of stock in the refining zone of each refiner and determine a consistency of stock using the obtained temperature or pressure; and a controller configured to regulate some aspect of operation for each refiner using the determined stock consistency of the corresponding refiner to keep the determined consistency at a consistency setpoint or within a consistency range.

67. A system for determining stock consistency comprising:

a plurality of rotary disk refiners that each comprise a plurality of refiner plates defining a refining zone therebetween in which stock is refined, a temperature or pressure sensor disposed in the refiner; and a plurality of pairs of sensors from which refiner motor power, refiner disk force, and refiner disk gap can be obtained or determined;

a processor that obtains or determines, for each rotary disk refiner, (a) a temperature or pressure of stock in the refiner, (b) refiner motor power, (c) refiner disk force, (d) refiner disk gap, (e) specific steam generation rate, (f) dry wood throughput, (g) latent heat of steam, (h) specific power, (i) wood heat capacity, (j) water heat capacity and uses at least the temperature or pressure of stock in the refiner, specific steam generation rate, dry wood throughput, latent heat of steam, specific power, wood heat capacity, water heat capacity in determining stock consistency for the corresponding rotary disk refiner.

68. The system according to claim 67 further comprising a DCS that is linked to the processor that is configured to provide the processor with plurality of refiner motor power, refiner disk force, and refiner disk gap that is used in determining stock consistency.

* * * * *